US009441897B2

(12) United States Patent
Mather et al.

(10) Patent No.: US 9,441,897 B2
(45) Date of Patent: Sep. 13, 2016

(54) SAFETY MECHANISM FOR FIREARM

(71) Applicant: Sturm, Ruger & Company, Inc., Southport, CT (US)

(72) Inventors: Jonathan Philip Mather, Grafton, NH (US); Benjamin K. Parker, Manchester, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/980,563

(22) Filed: Dec. 28, 2015

(65) Prior Publication Data

US 2016/0187090 A1 Jun. 30, 2016

Related U.S. Application Data

(60) Provisional application No. 62/096,981, filed on Dec. 26, 2014.

(51) Int. Cl.
*F41A 17/46* (2006.01)

(52) U.S. Cl.
CPC ..... *F41A 17/46* (2013.01)

(58) Field of Classification Search
CPC ..... F41A 17/46; F41A 17/56; F41A 17/64; F41A 17/00
USPC ..... 42/70.06, 70.01, 70.04, 70.05
See application file for complete search history.

(56) References Cited

U.S. PATENT DOCUMENTS 660,378 A 10/1900 Kalina
2,379,946 A 7/1945 Baker
2,453,683 A 11/1948 Caldow
3,735,519 A 5/1973 Fox
4,463,654 A 8/1984 Barnes et al.
4,569,145 A 2/1986 Ruger et al.
6,131,325 A * 10/2000 Kefer ..... F41A 17/32 42/70.05
7,428,795 B2 9/2008 Herring
7,908,779 B2 * 3/2011 Wasmer ..... F41A 9/53 42/1.05
8,109,025 B2 2/2012 Stone
8,132,496 B2 3/2012 Zukowski
8,276,502 B1 10/2012 Wright
8,464,456 B2 * 6/2013 Pichler ..... F41A 19/12 42/69.01
8,549,982 B2 10/2013 Troy, Jr. et al.

(Continued)

OTHER PUBLICATIONS

Corresponding International Search Report and Written Opinion for PCT/US15/67645 dated Mar. 16, 2015.

(Continued)

*Primary Examiner* — Joshua Freeman
(74) *Attorney, Agent, or Firm* — The Belles Group, P.C.

(57) ABSTRACT

A bolt action rifle with safety mechanism includes a receiver, barrel coupled to the receiver, and a trigger housing detachably coupled to the receiver. The trigger housing includes a trigger-actuated firing mechanism operable to discharge the rifle. A safety mechanism comprises a safety shaft and safety selector each rotatably mounted in the trigger housing and operably coupled together by a mechanical linkage, such as a rod in one embodiment. The safety selector comprises a control shaft and selector switch for operating the selector. Rotating the safety selector in a first direction rotates and engages the safety shaft with the trigger to disable the firing mechanism. Rotating the safety selector in a second direction rotates and disengages the safety shaft from the trigger to enable the firing mechanism for discharging the rifle. In one embodiment, the safety selector is mounted in a lower stock which includes a pistol grip.

26 Claims, 27 Drawing Sheets

(56) References Cited

U.S. PATENT DOCUMENTS

| | | | | |
|---|---|---|---|---|
| 8,572,880 | B2 | 11/2013 | Bender | |
| 8,615,915 | B2 | 12/2013 | Hunter et al. | |
| 8,650,789 | B2 | 2/2014 | Dionne et al. | |
| 8,677,666 | B2 * | 3/2014 | Pichler | F41A 17/46 42/70.01 |
| 8,683,729 | B2 | 4/2014 | Bova | |
| 8,756,847 | B2 | 6/2014 | Huther | |
| 2008/0302235 | A1 | 12/2008 | Lauck | |
| 2012/0090213 | A1 * | 4/2012 | Pichler | F41A 17/46 42/70.06 |
| 2012/0174453 | A1 * | 7/2012 | Kallio | F41A 17/46 42/70.02 |
| 2012/0174454 | A1 * | 7/2012 | Kallio | F41A 17/02 42/70.06 |
| 2012/0180354 | A1 | 7/2012 | Sullivan et al. | |
| 2016/0084599 | A1 * | 3/2016 | Alicea, Jr. | F41A 17/54 42/70.06 |
| 2016/0091268 | A1 * | 3/2016 | Miller, III | F41A 17/52 42/70.06 |
| 2016/0116250 | A1 * | 4/2016 | Mather | F41A 3/66 42/73 |
| 2016/0116251 | A1 * | 4/2016 | Mather | F41A 3/66 42/71.01 |

OTHER PUBLICATIONS

Instruction Manual for Ruger American Rifle Bolt-Action Rifle, 2015 Sturm, Ruger & Co., Inc., www.ruger.com , DBA 10-15 R5, pp. 1-40.

* cited by examiner

SAFETY MECHANISM FOR FIREARM

CROSS-REFERENCE TO RELATED APPLICATIONS

The present application claims the benefit of priority to U.S. Provisional Application Ser. No. 62/096,981 filed Dec. 26, 2014, the entirety of which is incorporated herein by reference.

BACKGROUND

The present invention generally relates to firearms, and more particularly to a safety selector mechanism suitable for a bolt-action firearm such as a rifle.

On some firearms it is desirable for ergonomic considerations, design constraints, aesthetics, or other reasons, to position a safety selector that controls the firing mode so that it must be contained within the stock assembly or another component that can be separated from the receiver or action. Pistol grips as popularized by the AR-15 genre of rifles (adopted by the U.S. military as the M16 rifle) have been commonly used on other types of modern firearms; often on rifles that were not originally designed for pistol grips. On bolt action rifles modified to add a pistol grip, the safety selector may be left in its original location typically alongside the back of the bolt or on top of the buttstock behind the bolt, which is not easily accessed when holding onto a pistol grip instead of cradling the stock. Hence, while acceptable for bolt action rifles without a pistol grip, this top-mounted safety selector location is inconvenient.

On firearms like the AR-15, where all of the fire-control components are contained in the lower receiver, the safety selector remains in the same relative position and does not hinder disassembly. If the fire-control group of components is connected to the receiver or action, while the safety selector is attached or contained within another component, it may be difficult to separate these components without disassembling additional rifle parts. This is especially true for rotating safety selectors, like used in AR-15 type rifles, where the cross shaft of the safety interacts with or intersects part of the fire-control group to block the firing mechanism. Optimally, the safety mechanism and selector switch should be strategically located to minimize the number of components which need to be disassembled to access to the firearm's firing mechanism.

Accordingly, an improved and more conveniently located safety selector design is desired for rifles with pistol grips other than the AR-15 rifle platform.

SUMMARY

A firearm according to the present disclosure includes a safety mechanism which allows the safety selector to be mounted in a removable stock component separate from the firing mechanism assembly mounted in a trigger housing, but can still be easily separated without additional disassembly of safety or fire-control components. In one implementation, the safety selector allows selection of a "safe" firing mode in which the firing mechanism is disabled and a "fire" firing mode in which the firing mechanism is enabled to discharge the firearm. The concept also prevents the stock component and trigger housing from being separated from the receiver unless the safety selector is in the "safe" position. When designed around an AR-15 compatible safety shaft, like the design described herein, the safety selector can be installed for either left or right hand operation.

Unlike an AR-15 rifle where the safety selector provides the direct physical restraint for the trigger, the present safety mechanism uses another separate component in the form of a safety shaft to interact directly with the trigger. The safety shaft, still operated by the safety selector, is located forward of the trigger in one embodiment to selectively engage or disengage the trigger; the trigger's movement being arrested when engaged to disable the trigger-actuated firing mechanism. The safety selector is mounted rearward of the trigger on the lateral side of the firearm in the same convenient position as used on an AR-15 rifle. However, the physically separated safety shaft and safety selector are mechanically coupled via a mechanical linkage such that rotating the selector concomitantly rotates and operates the shaft. A pistol grip may be provided which takes advantage of the side-mounted safety selector.

According to one aspect, a firearm with safety mechanism includes: a receiver; a barrel coupled to the receiver and defining a longitudinal axis; a trigger housing detachably coupled to the receiver; a trigger-actuated firing mechanism mounted in the trigger housing and operable to discharge the firearm via a trigger pull; a safety shaft extending transversely through the trigger housing and defining a first pivot axis, the safety shaft rotatable between a blocking position in which the safety shaft disables the firing mechanism and an unblocking position in which the shaft enables the firing mechanism to discharge the firearm; a safety selector comprising a control shaft extending transversely through the trigger housing and defining a second pivot axis, the safety selector mechanically coupled to the safety shaft such that rotation of the safety selector rotates the safety shaft, the safety selector rotatable between a safe position and a fire position; and a selector switch disposed on a first end of the control shaft for operating the safety selector. Rotating the safety selector about the second pivot in a first direction from the safe position to the fire position rotates the safety shaft about the first pivot axis from the blocking position to the unblocking position; and rotating the safety selector about the second pivot axis in a second direction from the fire position to the safe position rotates the safety shaft about the first pivot axis from the unblocking position to the blocking position.

According to another aspect, a trigger housing assembly attachable to a bolt-action firearm includes: a body defining an interior space and longitudinal axis; a firing mechanism disposed at least partially in the interior space, the firing mechanism operable to discharge the firearm via pulling a trigger movably mounted to the body; a safety shaft extending transversely through the trigger housing and defining a first pivot axis, the safety shaft rotatable between a blocking position in which the safety shaft disables the firing mechanism and an unblocking position in which the shaft enables the firing mechanism to discharge the firearm; a downwardly open vertical first slot formed in the body; a rotary cam rotatably disposed in the body proximate to the first slot, the rotary cam comprising a second slot having an open end and a closed end; the rotary cam rotatable between an aligned position in which the first and second slots are in vertical alignment and a misaligned position in which the second slot of the rotary cam is not in vertical alignment with the first slot of the body; a control rod coupling the rotary cam to the safety shaft; and a safety selector comprising a control shaft defining a second pivot axis and elongated selector switch extending radially outward from a first end of the control shaft for operating the safety selector, the control shaft inserted transversely through the first and second slots of the body and rotary cam respectively, the control forming a locking fit with the rotary cam such that rotating the safety selector concurrently rotates the rotary cam. Rotating the safety selector about the second pivot in a first direction from the safe position to the fire position concurrently rotates the safety shaft about the first pivot axis from the blocking position to the unblocking position; and rotating the safety selector about the second pivot axis in a second direction from the fire position to the safe position concurrently rotates the safety shaft about the first pivot axis from the unblocking position to the blocking position.

A method for operating a safety mechanism of a bolt-action rifle is provided. The method includes: providing a firearm including a longitudinal axis, a receiver, a barrel supported by the receiver, and a trigger housing comprising (1) a trigger-actuated firing mechanism operable to discharge the firearm, (2) a rotary safety selector including a control shaft extending transversely through the trigger housing and a selector switch, (3) a rotary safety shaft extending transversely through the trigger housing and including a blocking surface and an operating surface, and (4) a control rod operably coupling the safety selector to the safety shaft; rotating the safety selector in a first direction to a "safe" rotational position; concurrently rotating the safety shaft in a second rotational direction via the control shaft by rotating the safety selector in the first direction; engaging the blocking surface of the safety shaft with a trigger of the firing mechanism, wherein movement of the trigger is prevented to disable the firing mechanism; rotating the safety selector opposite to the first rotational direction to a "fire" rotational position; concurrently rotating the safety shaft opposite to the second rotational direction via the control shaft by rotating the safety selector opposite to the first rotational direction; disengaging the blocking surface of the safety shaft from the trigger of the firing mechanism; and aligning the operating surface of the safety shaft to the trigger providing clearance such that movement of the trigger is not prevented to enable the firing mechanism.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which:

All drawings are schematic and not necessarily to scale. Parts given a reference numerical designation in one figure may be considered to be the same parts where they appear in other figures without a numerical designation for brevity unless specifically labeled with a different part number and/or described herein. Parts described herein with respect to certain figures may also appear in other figures. Furthermore, a general reference to a whole figure number (e.g. FIG. 6) which may include multiple subparts (e.g. FIGS. 6A, 6B, etc.) shall be construed as a reference to all of the subparts unless specifically noted otherwise.

DETAILED DESCRIPTION

Figure 1:
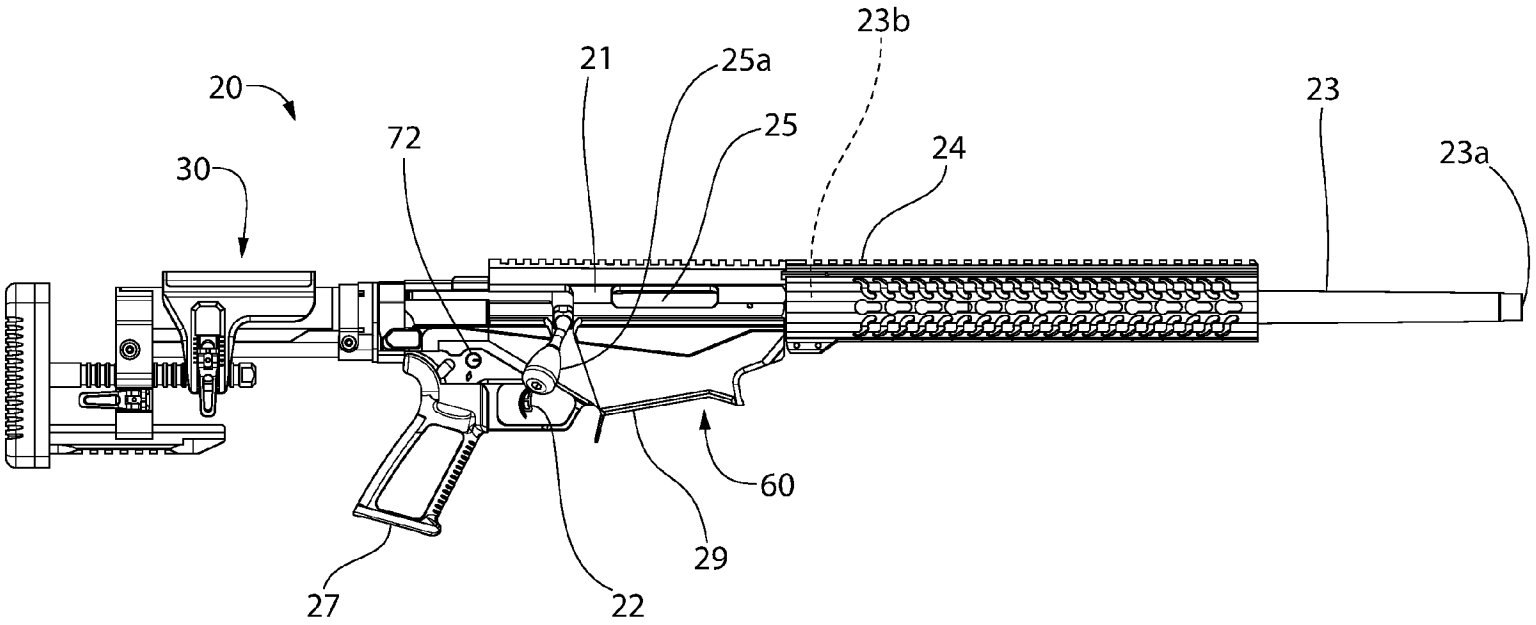
FIGS. 1 and 2 are right and left side views respectively of one embodiment of a firearm including a safety mechanism according to the present disclosure.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" is used herein in its conventional sense in the firearm art as meaning the mechanism that loads and ejects shells into/from the firearm and opens and closes the breech (i.e. the area in the receiver between an openable/closeable breech face on the front of the bolt and the rear face of the barrel chamber).

FIGS. 1-4 depict a firearm 20 with safety selector and interlock mechanisms according to the present disclosure. In one non-limiting example illustrated herein, the firearm 20 may be a bolt action rifle.

Figure 2:
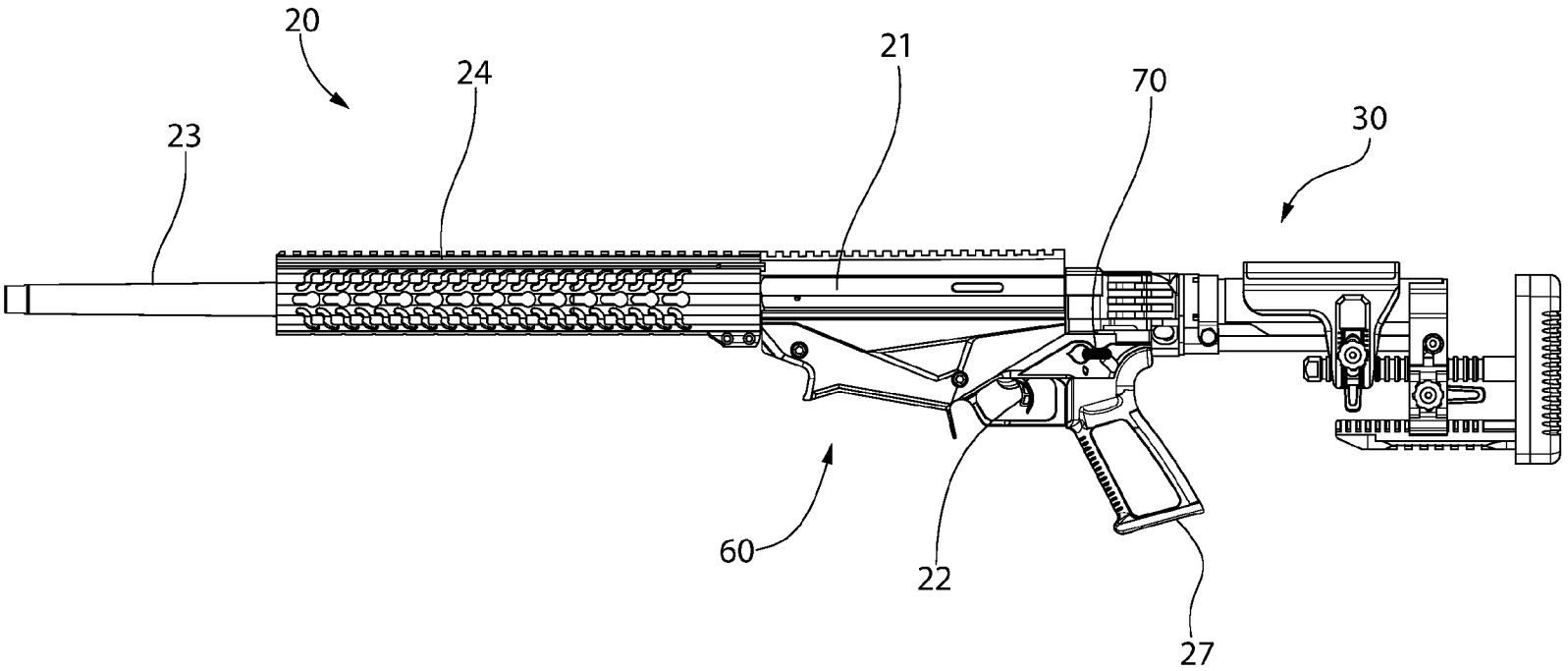
Figure 3:
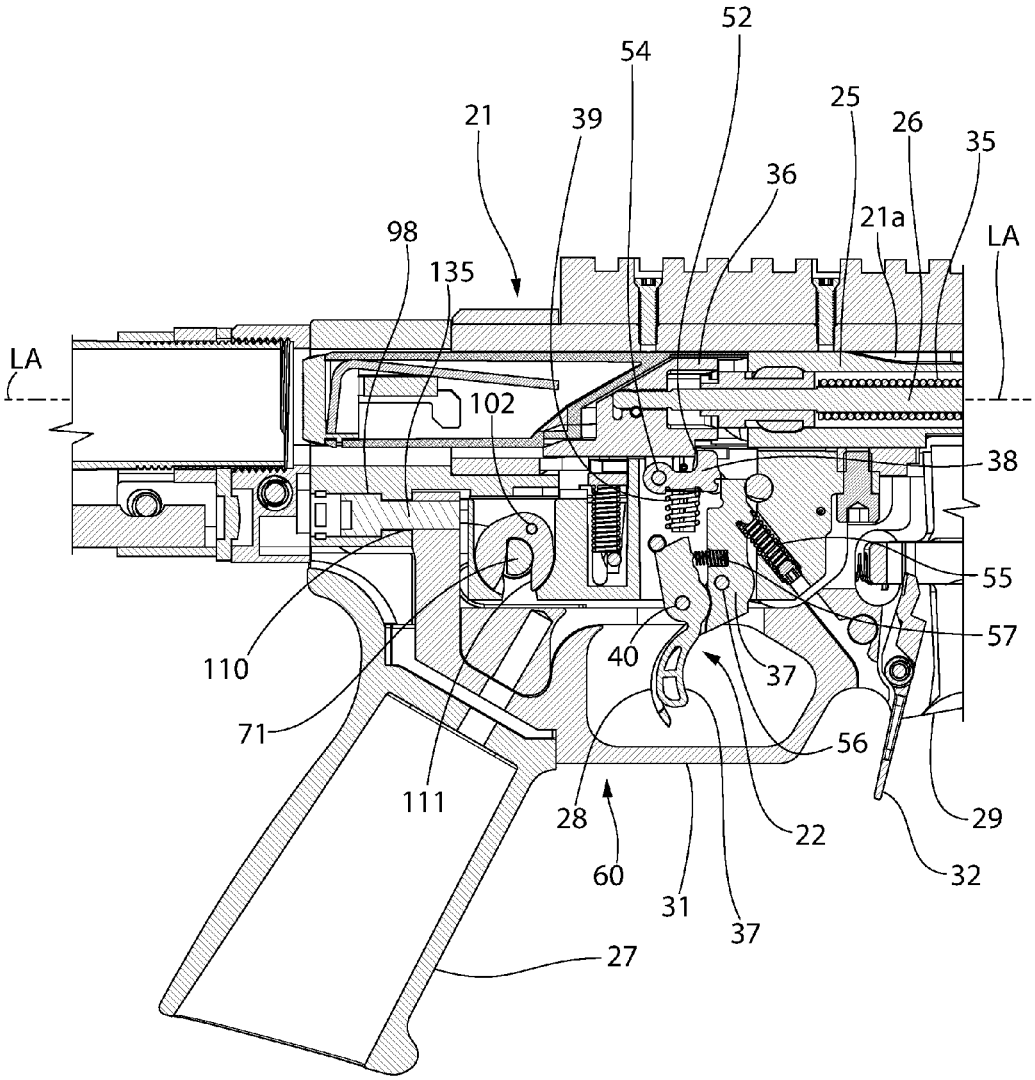
FIG. 3 is a partial right side view of the firearm showing the firing mechanism components.

Referring to FIGS. 1-3, firearm 20 generally includes a receiver 21, a trigger housing 22 detachably mounted to the receiver, a barrel 23 supported by the receiver, and optionally a handguard 24 enclosing and circumscribing at least part of the length of the barrel. The barrel includes an open front muzzle end 23*a* and an open rear breech end 23*b* (obscured beneath the handguard) coupled to the front end of the receiver 21 in any suitable manner (e.g. threading, interlocking lugs, barrel or lock nut, etc.). The barrel of rifle 20 defines a longitudinal axis LA and axial direction of the firearm coinciding with the centerline of the barrel 23 and its longitudinal bore formed therein between the muzzle and breech ends 23*a*, 23*b* (not shown) that defines the projectile pathway. Handguard 24 if provided may any type and coupled to the front end of the receiver and/or the barrel.

Firearm 20 further includes a buttstock 30 extending rearward from the receiver 21 for placement against the user's shoulder when aiming the firearm held in a ready-to-fire position to acquire a target. Buttstock 30 may be any type or configuration of buttstock including fixed, adjustable and non-adjustable types, and folding and non-folding types. The invention is not limited by the type of buttstock which may be used.

Firearm 20 further includes a lower assembly or stock 60, which in one non-limiting embodiment is detachably mounted to the bottom of the receiver 21. Lower stock 60 includes a front portion 33, opposing rear portion 34, trigger guard 31 position to enclose trigger 28, a pistol grip 27 rearward of the trigger guard, and magazine well 29 forward of the trigger guard. The magazine well is configured and structured to removably detain and latch an insertable box type ammunition magazine via pivotable latch 32 mounted to the lower stock 60 at the rear of the magazine well 29 (best shown in FIG. 3).

Figure 5:
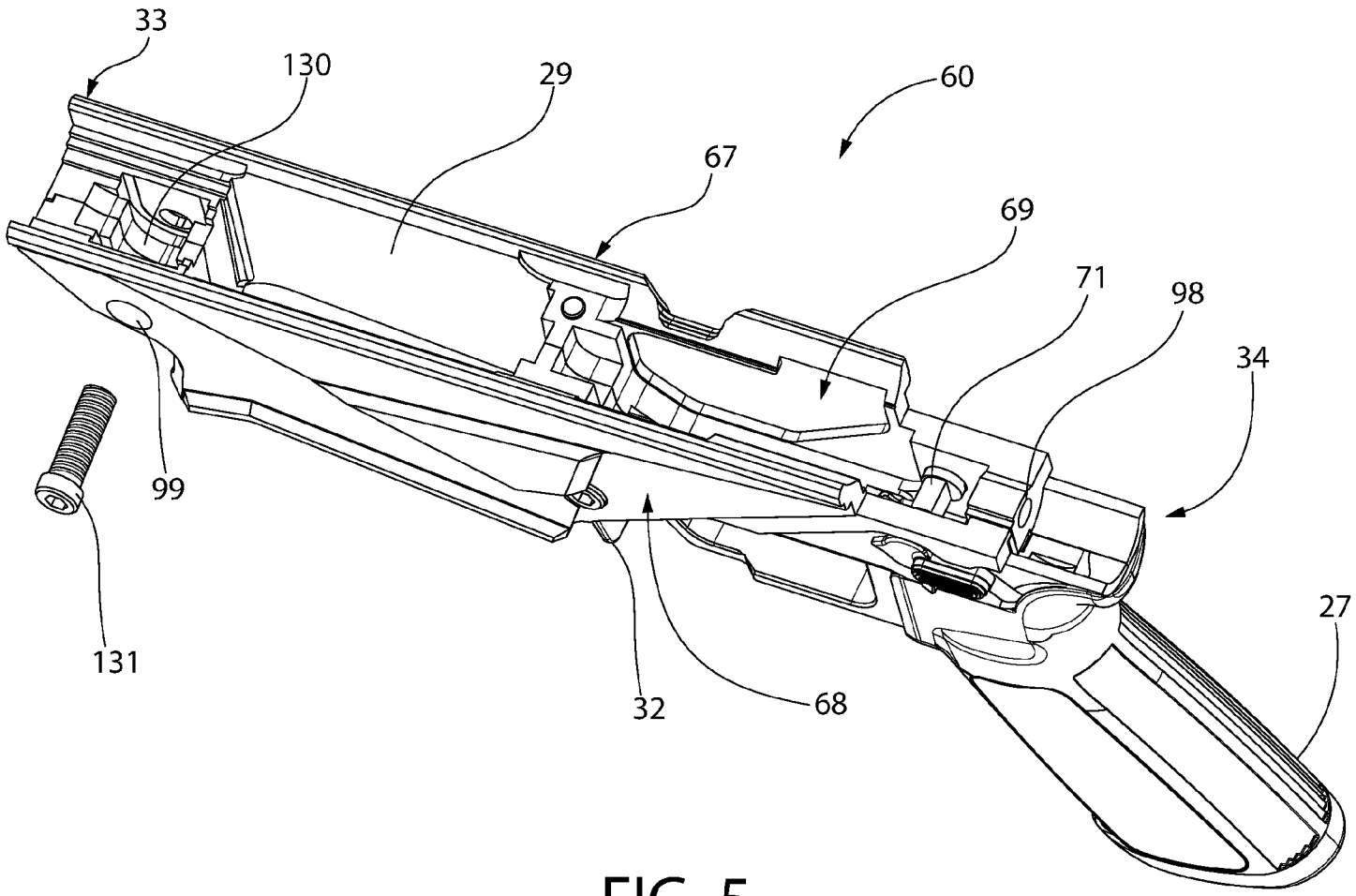
FIG. 5 is a top perspective view of a removable lower assembly or stock of the firearm of FIG. 1.
Figure 6:
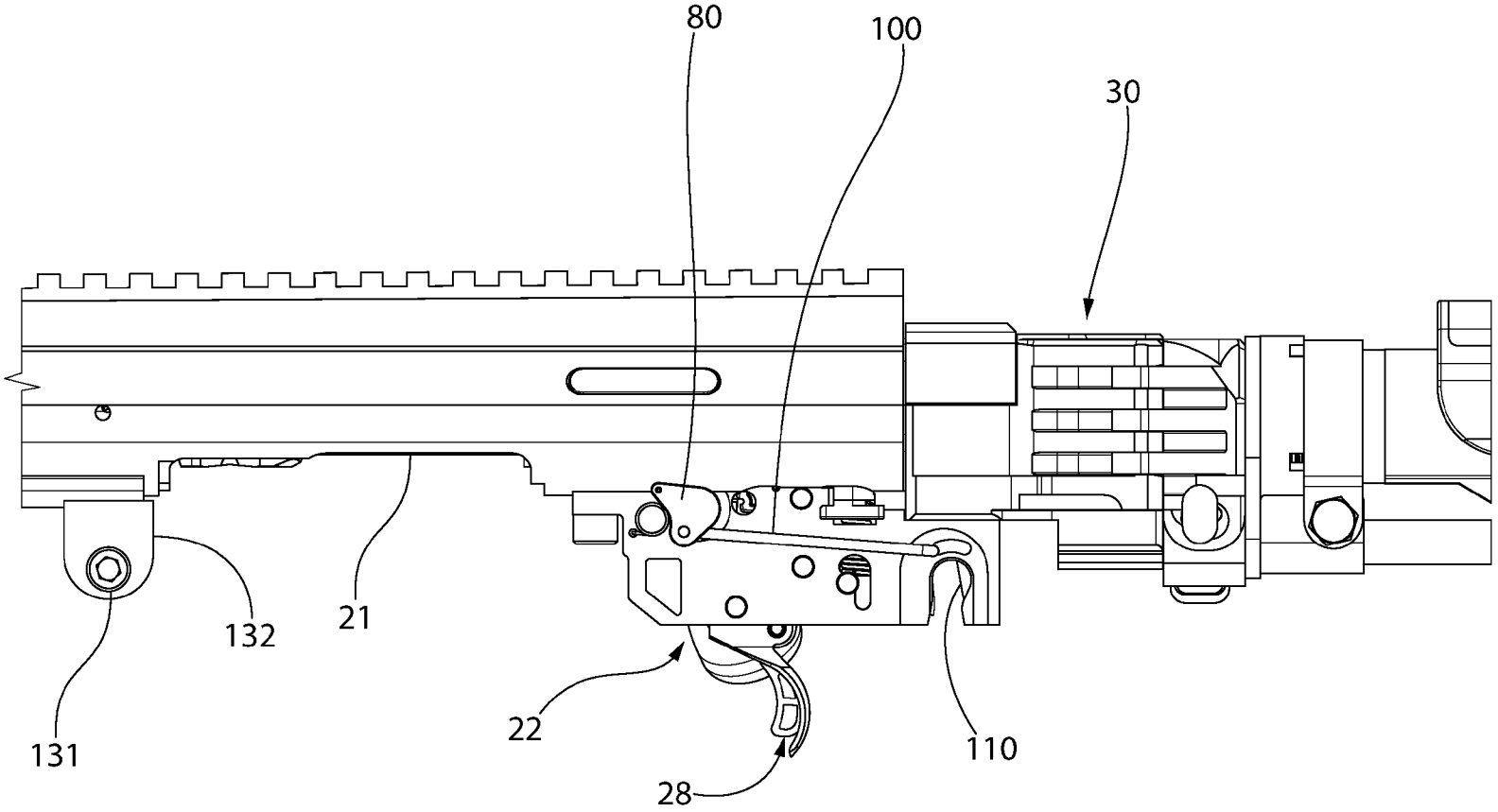
FIG. 6 is a partial left side view of the firearm with the lower stock removed.

In one non-limiting implementation, there are two mounting points which may be used to secure the lower stock 60 to the receiver 21. Referring to FIGS. 3, 5, and 6, a front mounting features includes an upwardly open locking recess 130 in lower stock 60 configured with a raised central rib. Recess 130 receives dual laterally spaced mounting lugs 132 projecting downwards from the front portion of receiver 21. One of the lugs 132 (far or right lug) has a threaded hole and one lug (near or left side) has a clearance hole. When the lower stock 60 is raised into place on the bottom of the receiver 21, the lugs 132 are positioned on opposite sides of the raised rib central which is received between the lugs. In one configuration, the bottom of the lugs 132 may be convexly rounded and the recess 130 on opposite sides of the central rib may be concavely round by arcuate walls of the lower stock formed at the bottom of the recess (best shown in FIG. 5). Once the upper is raised into place, a threaded bolt 131 is inserted through hole 99 in the left lateral side 68 of the lower stock 60, passing through the clearance hole in the near side lug and engaging the threaded hole in the far side lug. When tightened, the lugs 132 are pulled together to compress the central rib in recess 130 of the stock 60 thereby securely holding the stock laterally to the receiver while the bolt 131 also retains the lower stock vertically.

The second rear mounting feature can be seen in FIGS. 3 and 5. A socket head cap screw or other type threaded fastener 135 is inserted from the back of the firearm through the receiver 21 and lower stock 60. An axial threaded hole 98 formed in the rear of the lower stock receives the threaded fastener 135 extending through and from a concentrically aligned hole in the receiver which secures the rear end of the lower stock 60 to the receiver. Preferably, this fastener 135 should be secured first, which helps brings the lower into a more consistent position and alignment relative to the receiver 21 and trigger housing 22, and afterwards the front bolt 131 may next be tightened lastly. However, in other possible lower stock mounting sequences, the front bolt may be secured first before the rear bolt.

The fire control mechanism and safety will now be described.

The receiver 21 supports portions of the trigger-actuated fire control mechanism operable to discharge the firearm 20. The fire control mechanism includes an axially movable and elongated bolt 25 which may include a bolt handle 25*a* for manually operating the action to form a closed or open breech in relation to the chamber formed at the rear breech end 25*b* of barrel 25 which holds an ammunition cartridge. The bolt 25 is slidably moveable forward/rearward in an axially extending internal cavity 21*a* of receiver 21. The bolt assembly comprises a slidable striker or firing pin 26 carrier inside the bolt 25 for detonating a chambered cartridge when the firearm is discharged, a main spring 35 which acts to bias the firing pin rearward in a cocked ready-to-fire position, and a cocking piece 36 attached to the rear end of the firing pin (best shown in FIG. 3). The foregoing firing mechanism components are mounted in and supported by the receiver 21.

Figure 9:
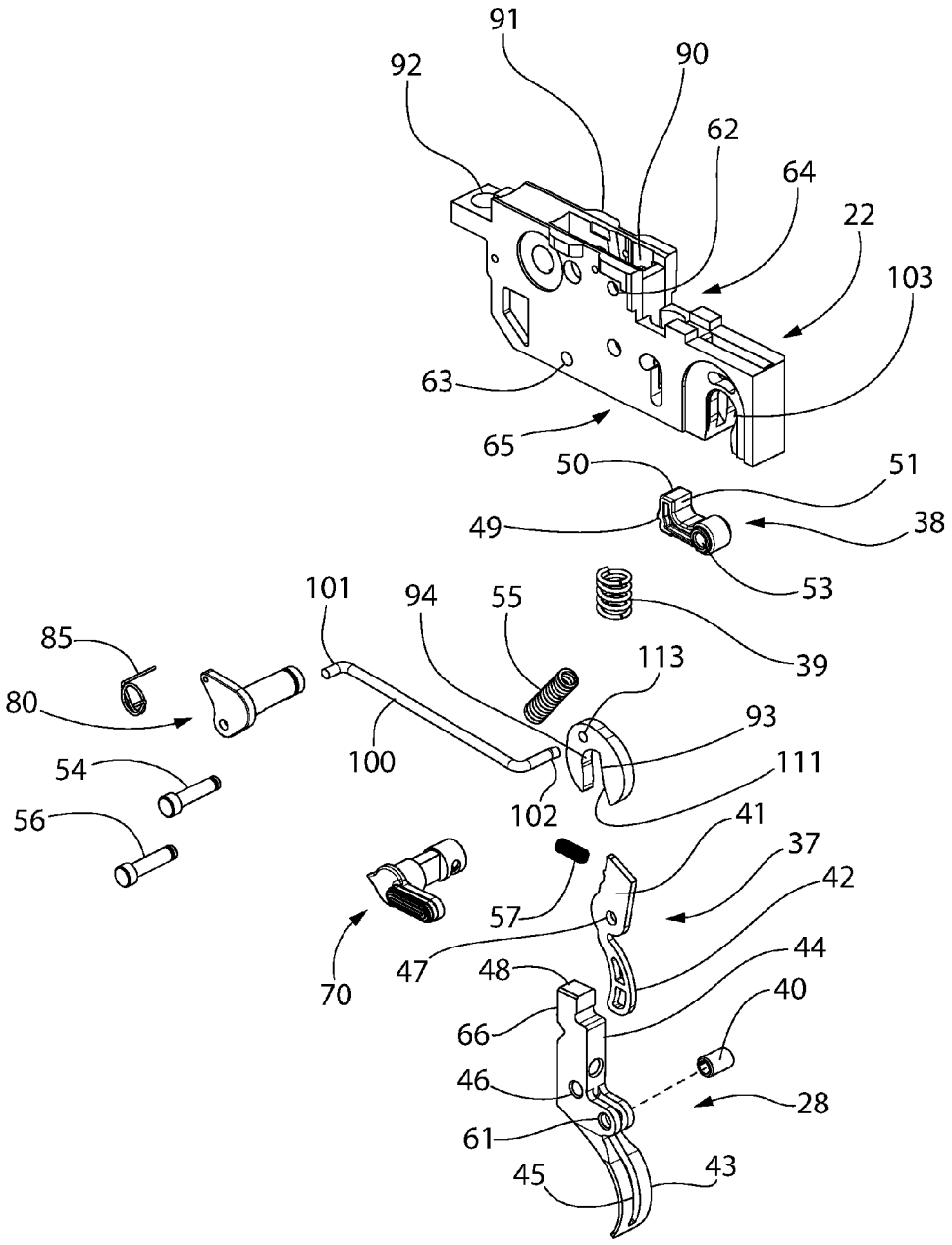
FIG. 9 is an exploded perspective view thereof.

The trigger housing 22 supports the other portions of the firing mechanism which operate together via pulling trigger 28 to release a cocked firing pin 26 for discharging the firearm. Referring to FIGS. 3 and 9, the trigger housing 22 has a generally rectangular elongated body defining an interior space 90 and various external openings to access the space for housing various firing mechanism components described herein. Trigger housing 22 may be removably attached to the receiver 21 by a variety of mechanical means. In one embodiment, the trigger housing may include a plurality of laterally extending tabs 91 which interlock with mating tabs formed in the underside of the receiver (not shown) to suspend the housing from beneath the receiver. One or more fastener openings 92 may be provided which receive fasteners therethrough to complete securement of the trigger housing 22 to the receiver 21. In other possible embodiments, fasteners alone may be used to secure the trigger housing to receiver. Other mechanical methods or combinations of methods may also be used. The invention is not limited by the type of means used to detachably secure the trigger housing to the receiver. Preferably, the trigger housing 22 is securely attached to the receiver 21 of the firearm to ensure that the relationship between the sear 38 and the firing pin cocking piece 36 used to hold or release the firing pin 26 is maintained to prevent variable trigger feel and uncontrolled disengagement. The trigger housing 22 cannot be removed without first removing the lower stock 60 assembly from the firearm.

The firing mechanism components supported by the trigger housing 22 includes a dual trigger mechanism including trigger 28 and trigger release member 37 which cooperates with the trigger to release a sear 38. Trigger 28 is movably mounted to trigger housing 22. In one non-limiting embodiment as illustrated, the trigger is pivotably mounted to the module about transverse pin 56 which defines a pivot axis of the trigger. The trigger release member 37 is pivotably mounted to the trigger 28 about a second transverse pin 40 which is disposed just rearward of the trigger pin 40. This defines a separate pivot axis for the release member which is parallel to the trigger's pivot axis. Both the trigger 28 and the trigger release member 37 pivot in forward and rearward axial directions parallel to the longitudinal axis LA, as further described herein.

Trigger 28 has a vertically elongated body including a lower arcuately curved operating end 43 for engaging a user's trigger finger and a vertically elongated upper sear catch protrusion 44 protruding upwards from the operating end. Lateral mounting hole 46 receives transverse pin 56 to pivotably mount the trigger to the trigger housing 22. Sear catch protrusion 44 includes an upward facing ledge 48 configured and arranged to selectively engage a mating downward facing hook-shaped sear catch 49 formed on the sear 38 for holding the sear in an upright position until the firearm 20 is discharged.

The trigger release member 37 has a vertically elongated flat or plate-like elongate body defining an arcuately curved lower operating end 42 shaped for engaging a user's trigger finger and upper extension 41 protruding upwardly from the operating end. Lateral mounting hole 47 in the release member and mounting hole 61 in the trigger 28 receive transverse pin 40 to pivotably mount the release member to the trigger 28. The release member 37 is therefore supported by and movable in relation to the trigger. The operating end 42 of release member 37 is slideably received through a vertical slot 45 in curved operating end 43 of the trigger 28.

Sear 38 has a horizontally elongated body including catch 49 formed on the front side or face, and an upwardly extending and vertically elongated firing pin catch protrusion 50. Lateral mounting hole 53 receives transverse pin 54 to pivotably mount the sear 38 to the trigger housing 22. Firing pin catch protrusion 50 defines a rear facing blocking surface 51 which is configured and arranged to abuttingly engage a mating front facing stop surface 52 formed on the cocking piece 36 of the bolt assembly (see, e.g. FIG. 3). Sear spring 39 biases the sear 38 into an upwards blocking position about pin 54 to force and positively maintain blocking surface 51 against stop surface 52 to prevent the release of the firing pin absent a trigger pull. In one embodiment, spring 39 may be a helical compression spring; however, other types of springs (e.g. torsion) may be used.

Trigger 28 in turn is biased into an upwards position about pin 56 by trigger spring 55. In one embodiment, spring 55 may be a helical compression spring; however, other types of springs (e.g. torsion) may be used. Spring 55 acts on the vertical front side or surface 66 of the sear catch protrusion 44 of trigger 28 at a point above pin 56. This biases the trigger rearwards towards sear 38 which is mounted behind the sear catch protrusion 44 in the trigger housing 22. This in turn also forces the ledge 48 into positive engagement with the sear catch 49 on sear 38 for holding the sear in the upwards blocking position with a cocked firing pin 26. Spring 55 may be obliquely arranged to the longitudinal axis LA of firearm 20 to provide a line of action (extending along the axial centerline of the spring between its ends) which intersects the sear. This provides positive engagement of the ledge 48 on the trigger sear catch protrusion 44 with the sear catch 49. The sear catch protrusion 44 of trigger 28 is pivotable forwards about pin 56 to disengage and release the firing pin 26, as further described herein.

A spring 57 is disposed between and has opposing ends which act against both the trigger 28 and trigger release member 37, as seen in FIG. 3. The spring 57 is located above transverse pins 40 and 56 to bias the upper portions of the trigger and trigger release member apart. This in turn biases the curved lower operating end 42 of the trigger release member 37 to protrude forward beyond the curved lower operating end 43 of trigger 28 to maintain the release member. It bears noting that spring 57 is typically smaller in size than and has a lower spring force than trigger spring 55 so that the rearward spring force of spring 55 dominates and maintains positive engagement between the sear catch protrusion 44 and firing pin 26.

The firearm 20 may be discharged in the following manner. Referring to FIG. 3, the firing mechanism is shown in a ready-to-fire position. With addition reference to FIG. 9, the bolt 25 is forward in a closed breech position in battery with the barrel 23 wherein a cartridge is chambered in the breech end 23*b*. Firing pin 26 is held rearward in a cocked position by sear 38 via engagement between blocking and stop surfaces 51, 52 of the sear and cocking piece 36 of the bolt respectively. The sear 38 is in the upwards blocking position being held there by the trigger release member 37 which similarly is in its upwards blocking position by spring 55. Trigger 28 is in a substantially vertical non-pulled position.

Figure 7:
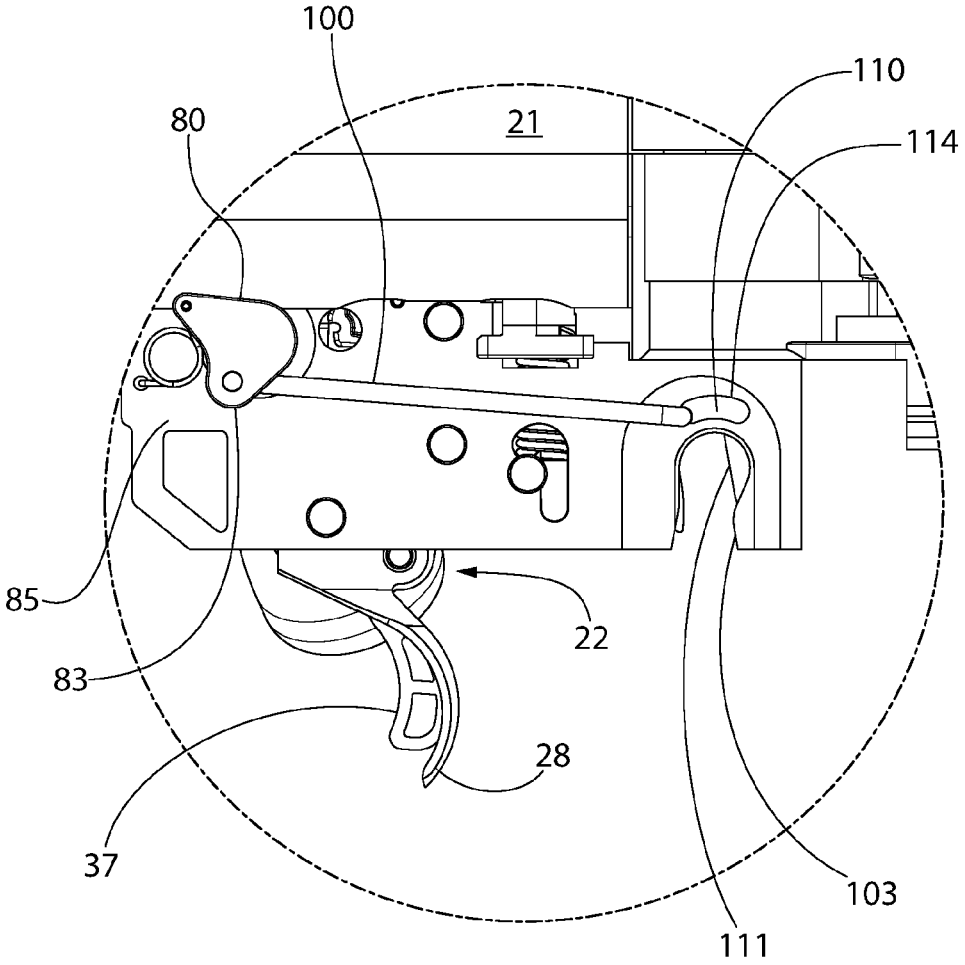
FIG. 7 is a detailed view taken from FIG. 6.

To discharge the firearm, a user first pulls the exposed portions of the trigger 28 (via lower operating end 43) and trigger release member 37 (via lower operating end 42) rearward. It should be noted that the user initially engages the lower operating end 42 of the trigger release member 37 which protrudes forward of the trigger 28 in the normal un-pulled position (see, e.g. FIGS. 3, 7, and 8). The trigger release member moves rearward compressing spring 57 against the sear catch protrusion 44 which remains stationary at this stage until the front of operating end 42 of the trigger release member 37 is flush with the front of the operating end 43 of the trigger 28. It bears noting that trigger block pin 132 (see, e.g. FIG. 10B) blocks the trigger movement until the trigger release is moved.

Continued pulling of both the trigger 28 and trigger release member 37 rearward together (counter-clockwise in FIG. 3) now rotates the upper extension 41 and sear catch protrusion 44 of the trigger release member and trigger respectively forward (clockwise in FIG. 3) against the rearward biasing force of spring 55. The ledge 48 on the trigger sear catch protrusion 44 disengages the sear catch 49 on sear 38. The sear 38 rotates downwards (clockwise in FIG. 3) to disengage the sear blocking surface 51 from the firing pin stop surface 52 on the cocking piece 36. The firing pin 26 is thus released and moves forward assisted by main spring 35 to strike its forward end against the chambered cartridge which is detonates to discharge the firearm.

According to one aspect of the invention, a mechanical safety mechanism is provided which acts to selectively arrest and disable the foregoing firing mechanism. This is intended to prevent inadvertent discharge of the firearm even if a trigger pull is attempted while the safety is "on." Advantageously, the present safety mechanism provides for a bolt action rifle the convenience of a side-mounted AR-15 style safety selector with pistol grip both traditionally found only on conventional AR-15 semi-automatic action type rifles.

Referring to FIGS. 6-11 inclusively, a safety mechanism in one embodiment generally comprises a safety shaft 80, a safety selector 70, and a safety operating linkage such as control rod 100 operably coupling the shaft and selector together. The control rod operates and controls the position of the safety shaft 80 via rotating the safety selector 70, as further described herein. Both the safety shaft and safety selector are mounted to the trigger housing 22.

The control rod 100 may a wire-form linkage to allow actuation of the safety shaft 80 from a different location or even a different amount of rotation. The safety shaft 80 in the illustrated embodiment is disposed forward of trigger 28 and the safety selector 70 is disposed rearward of the trigger in the trigger housing. This linkage system allows the safety selector position to be less critical because it is not directly contacting the trigger to arrest its movement. This is important because when the safety selector is connected to a different component than the trigger housing, very tight tolerances would be required to maintain a close relative position.

The safety shaft 80 extends transversely through the trigger housing 22 between right and left opposing lateral sides 64, 65 of the housing and defines a pivot axis. With additional reference to FIGS. 21-29 showing details of the safety shaft 80, the shaft has a generally cylindrical shape and includes opposing ends 81, 82. A diametrically enlarged operating protrusion 83 extends radially from a first end 81 of the safety shaft in a direction perpendicular to the length of the shaft for coupling to the control rod 100. In one embodiment, protrusion 83 may have an oblong or lobed shape as illustrated. An aperture 84 is formed in protrusion 83 which receives a first hook-shaped curved end 101 of control rod 100 (see also FIGS. 8 and 9). Because aperture 84 is disposed radially distant and apart from the safety shaft 80, this arrangement provides added leverage to easily rotate the shaft using rod 100 against the biasing force spring 85. Spring 85 may be a torsion spring in one embodiment and biases the safety shaft 80 into two rotational positions shown in FIGS. 10A and 11A. One end of spring 85 engages the trigger housing as shown and the other end engages hole 133 formed in protrusion 83 (see, e.g. FIG. 21). Spring 85 helps stabilize rotational motion of the safety shaft. Other types of springs may be used in other embodiments.

The safety shaft 80 is rotatable between a blocking position in which the safety shaft disables the firing mechanism and an unblocking position in which the shaft enables the firing mechanism to discharge the firearm. Safety shaft 80 comprises a substantially flat operating surface 86 and a circumferentially adjoining arcuate blocking surface 87 formed by full diameter portions of the shaft on either side of the flat. The flat operating surface 86 is rotatable in radial position with the safety shaft. The term "substantially flat" indicates that although the operating surface 86 may be considered flat with respect to the arcuate blocking surface 87, the operating surface may in fact have a compound shape with portions of the surface 86 varying slightly in angularity to other portions of the surface 86 such as by 10 degrees or less; however, the overall profile of the operating surface may still be considered flat. The "flatness" of the surface will be dictated in part by configuration of the trigger 28 as explained below.

To enable the firing mechanism, the flat operating surface 86 is rotatable to a position arranged approximately parallel to a front surface 66 of the trigger 28 when the safety shaft is in the unblocking position. This provides a horizontal gap or clearance between the front surface 66 and flat operating surface 86 which allows pivotable movement of the trigger 28 sufficient to release the sear 38 and discharge the firearm by disengaging the cocking piece 36 of the firing pin 26. This corresponds to the rotational "fire" position of the safety selector 70.

To disable the firing mechanism, the safety shaft 80 is rotated to engage the arcuate blocking surface 87 with the front surface 66 of the trigger 28 when the safety shaft is in the blocking position. This prevents pivotable movement of the trigger sufficient to release the sear 38 and discharge the firearm. Movement of the trigger-actuated firing mechanism to discharge the firearm is therefore arrested. This corresponds to the rotational "safe" position of the safety selector 70.

The safety selector 70 will now be further described. With additional reference now to FIGS. 12-20 showing details of the safety selector 70, the safety selector comprises a cylindrical control shaft 71 which extends transversely through the trigger housing 22 between the right and left opposing lateral sides 64, 65 of the housing when positioned therein. The control shaft 71 defines opposing ends 72 and 73, and a pivot axis of the safety selector 70. In one embodiment, the pivot axis of the safety selector 70 is located lower in trigger housing 22 than the pivot axis of the safety shaft 80. An elongated selector switch 74 is disposed on a first end 73 of the shaft for operating the safety selector via a user's finger or thumb. The selector switch 74 extends radially in a direction perpendicular to the length of the control shaft 71 and may have any suitable shape and a surface texture selected to facilitate grasping by a user in some embodiments (e.g. ridges, knurling, etc.).

In one embodiment, the selector switch 74 may further comprise a firing mode indicator 79 adjoining end 73 of the control shaft 71. The indicator 79 may be circular in one embodiment and have a diameter the same as, or in a preferred embodiment larger than the diameter of the adjoining control shaft. An arrow 75 may be formed on the firing mode indicator 79 which is rotatable to point to indicia comprising for example "safe" and "fire" which optionally may be engraved in or otherwise marked on the lower stock 60 (e.g. lateral side 68) adjacent to the indicator. Other firing modes and indicia may be provided.

In one embodiment, the safety selector 70 is mounted in the lower stock 60 and supported independently of the trigger housing 22 such that removal of the lower stock from the firearm 20 and receiver 21 removes the safety selector with the lower stock without removing the safety selector from the lower stock or disassembling the safety or firing mechanism components. FIG. 5 shows this arrangement in the lower stock 60 with the control shaft 71 extending transversely and being received through apertures in opposing lateral right and left sides 67, 68 of the stock. In one embodiment, the end 72 of the control shaft 71 opposite the selector switch 74 penetrates lateral side 67 of the lower stock 60 and is exposed for viewing by the user. End 72 may be provided with firing mode indicia 77 (e.g. line, shape, etc.) which aligns with markings/indicia (e.g. "safe" and "fire") emplaced on the right lateral side 67 of the lower stock 60 to signal whether the safety selector 70 is in one of the two operating positions. Other firing modes and indicia may be provided.

It should be noted that the lateral sides 67, 68 of the lower stock 60 are spaced apart defining an axially elongated internal cavity 69 which is upwardly open to receive the trigger housing 22 therein when the lower stock is attached to the receiver 21.

According to another aspect, another benefit of the present design described here is that the safety selector 70 is held in place by the trigger housing, and not with a spring and plunger like the selector in an AR-15 rifle. Not only does this eliminate parts, but it makes it possible to reverse a standard AR-15 selector to provide the same function with the safety lever on either the left or right side. Eliminating the drag from the spring loaded plunger also allows the safety to rotate more smoothly and reduce the likely hood of the selector coming to rest in a partially engaged or disengaged position.

Figure 12:
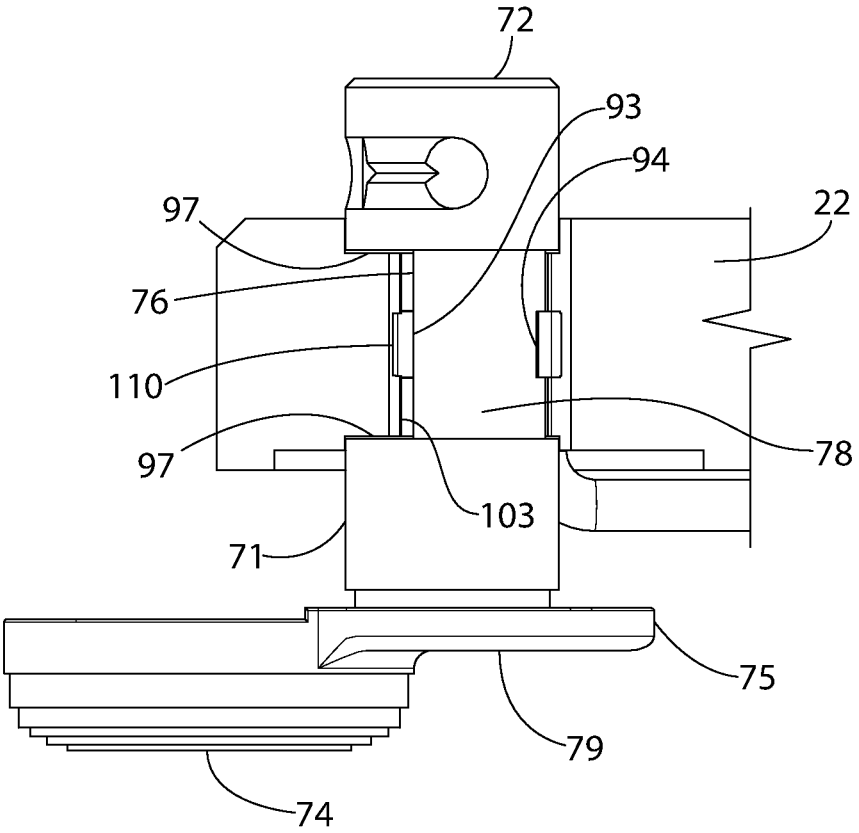
FIG. 12 is a bottom plan view of the trigger housing showing the safety selector mounted therein.
Figure 13:
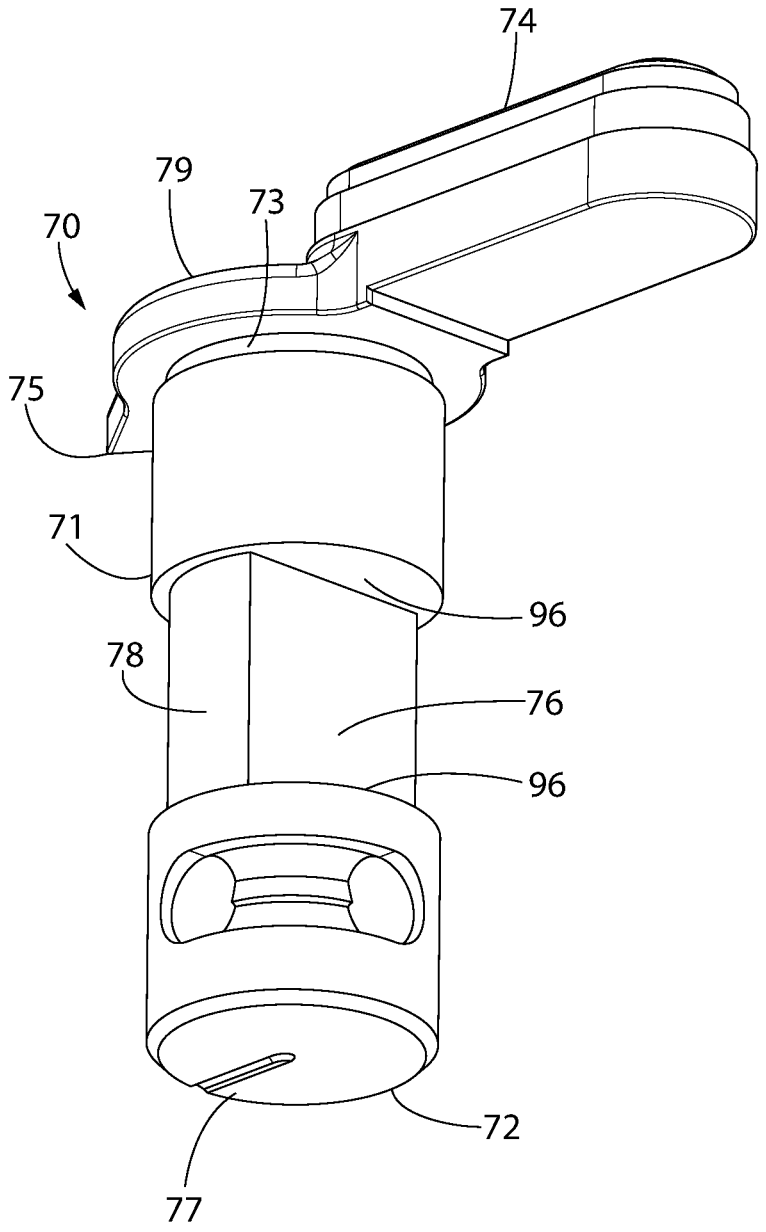
FIG. 13 is a perspective view of the safety selector.
Figure 14:
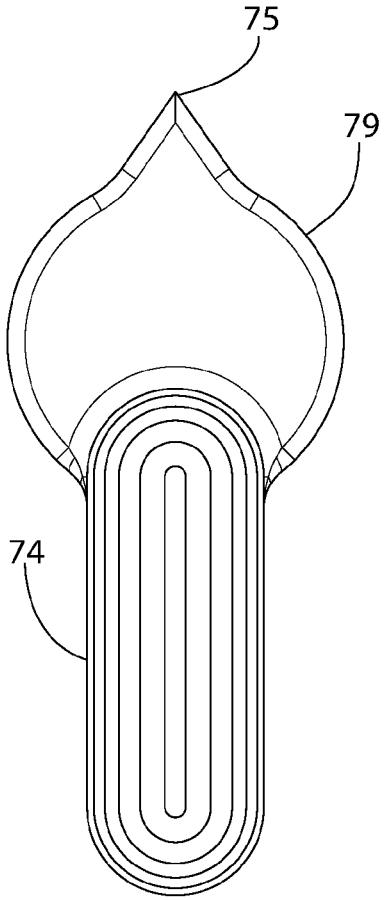
FIGS. 14 and 15 are left and right side views thereof.
Figure 15:
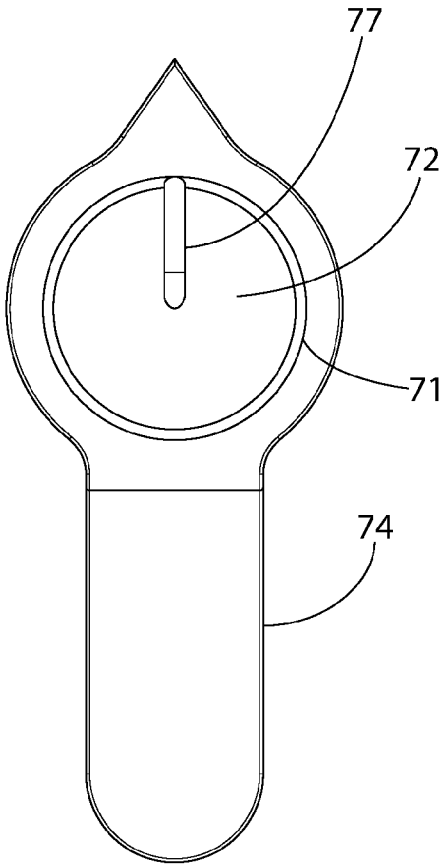
Figure 16:
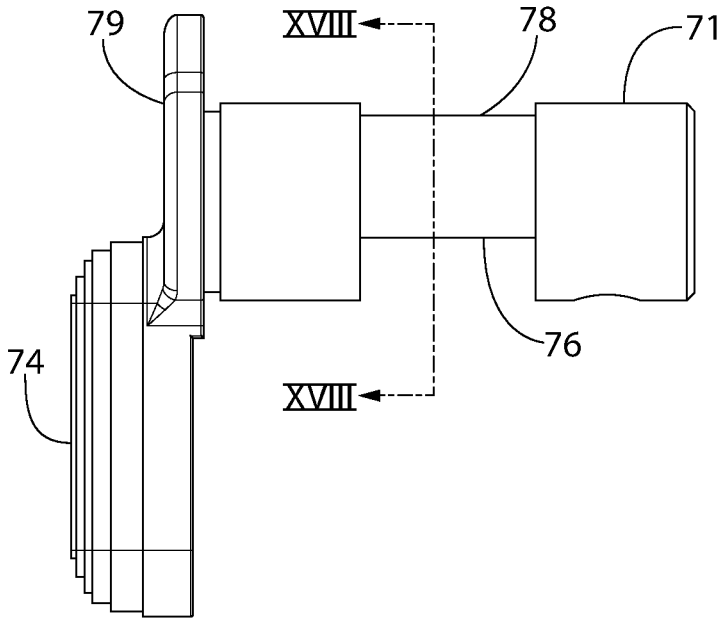
FIGS. 16 and 17 are top and bottom plan views thereof.
Figure 17:
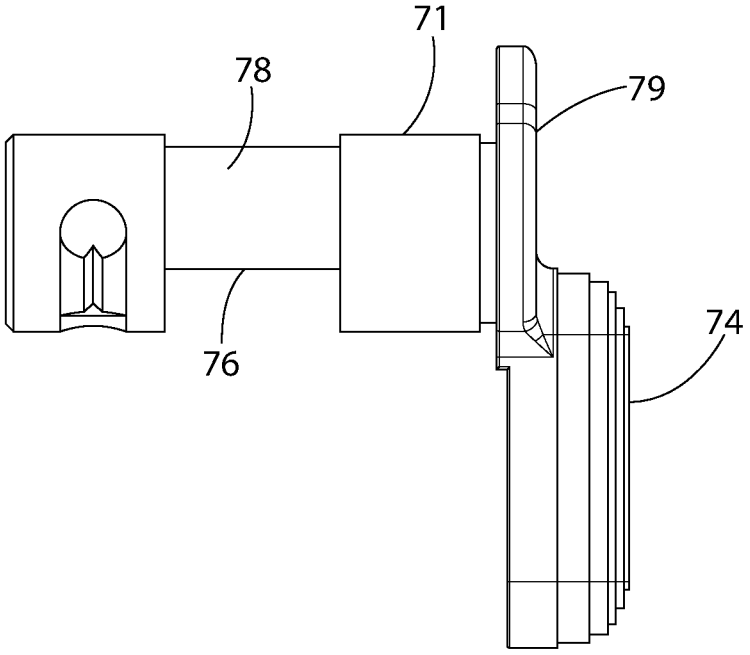

FIGS. 12 and 13 are referenced now to describe this interface between the safety selector 70 and trigger housing 22. The control shaft 71 of the safety selector 70 may have a stepped configuration defining a reduced diameter central portion formed by spaced apart shoulders on shaft. A pair of inward facing and opposing abutment surfaces 96 is formed by the stepped shaft 71. Abutment surfaces 96 abuttingly engages mating outward facing abutment surfaces 97 formed on each side of the vertical slot 103 in the housing. In this arrangement, the safety selector control shaft 71 can only be downwardly withdrawn from the slot 103 in the trigger housing 22, and not laterally removed therefrom.

Once the lower stock 60 is separated from the receiver 21, the safety selector 70 can be removed from the lower stock just be sliding it laterally outwards. While installed on the receiver 21, however, the trigger housing 22 prevents the selector from sliding laterally out of the stock or trigger housing. If an ambidextrous style selector is used, with a lever or switch 74 on each side which may be provided in some implementations, it would first have to be disassembled for removal from the lower assembly.

Figure 18:
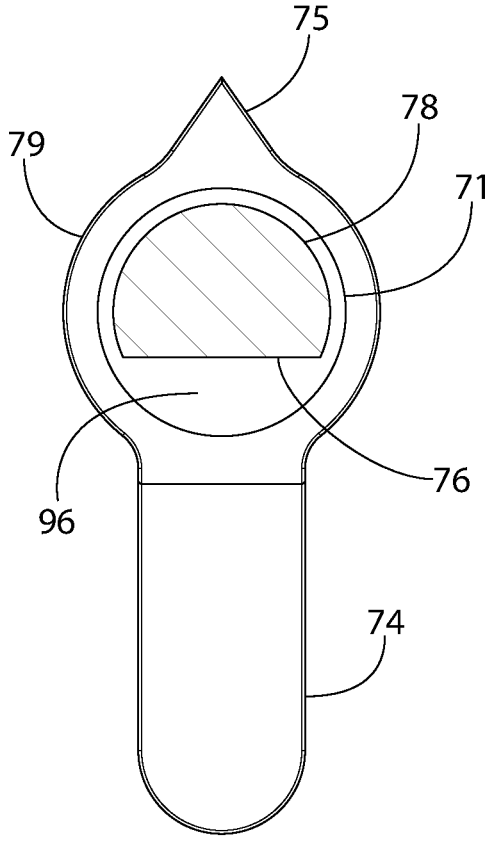
FIG. 18 is a transverse cross-sectional view thereof.
Figure 19:
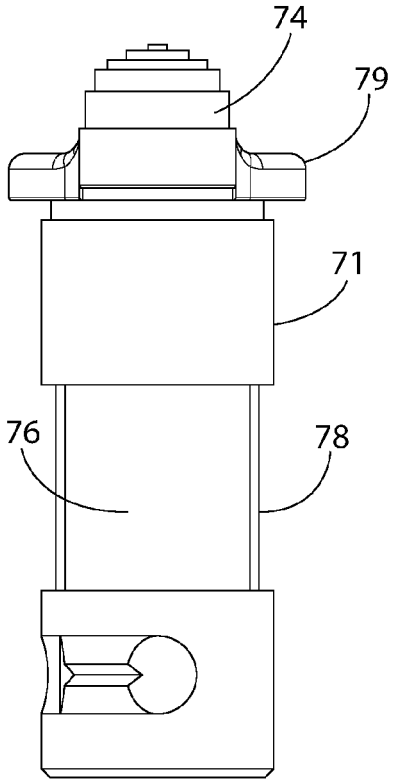
FIGS. 19 and 20 are rear and front views thereof.
Figure 20:
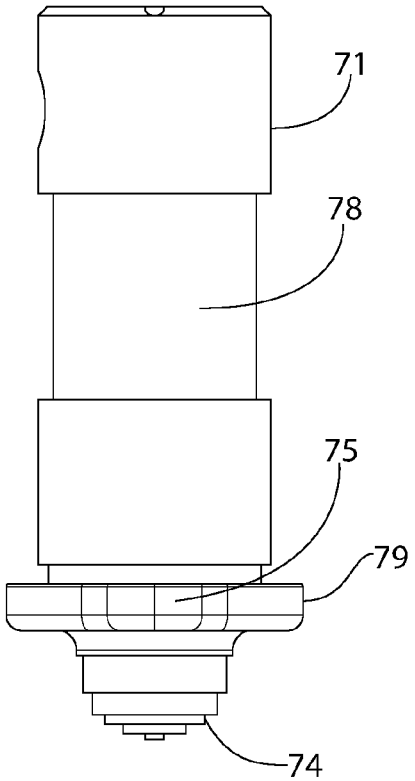
Figure 21:
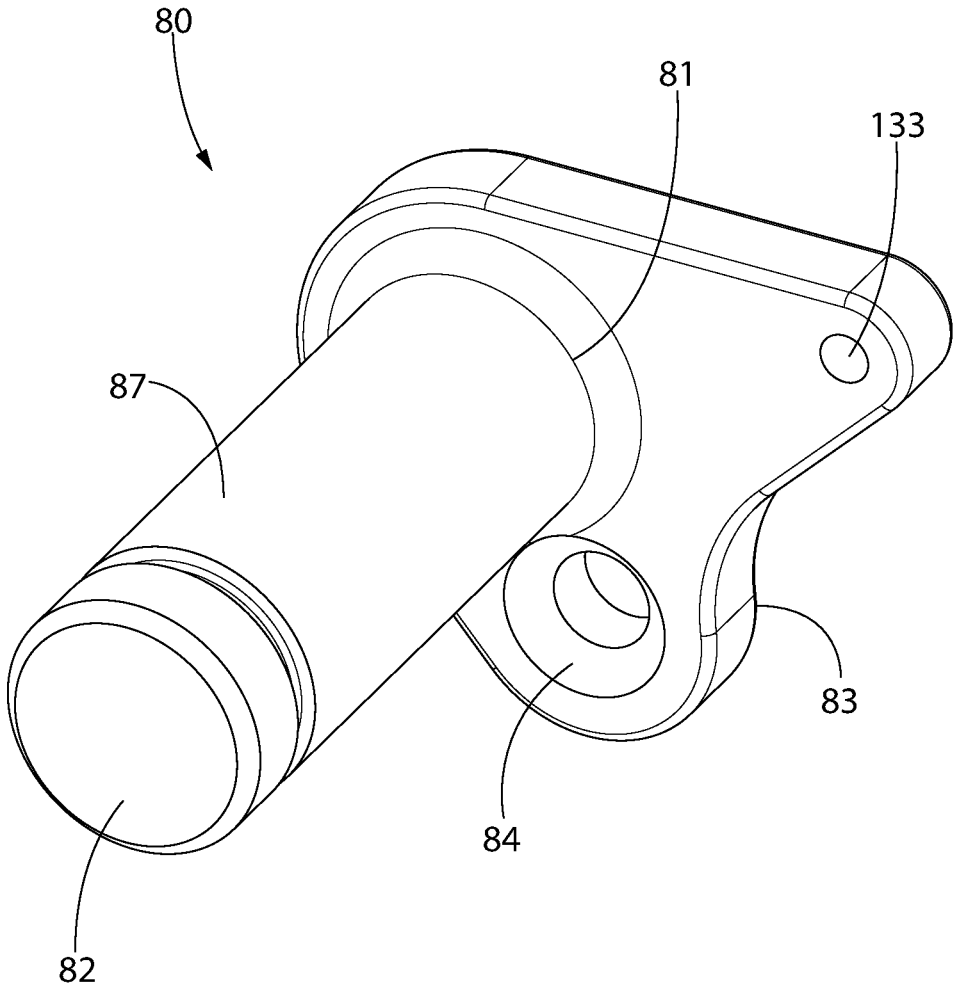
FIG. 21 is a right perspective view of the safety shaft.
Figure 22:
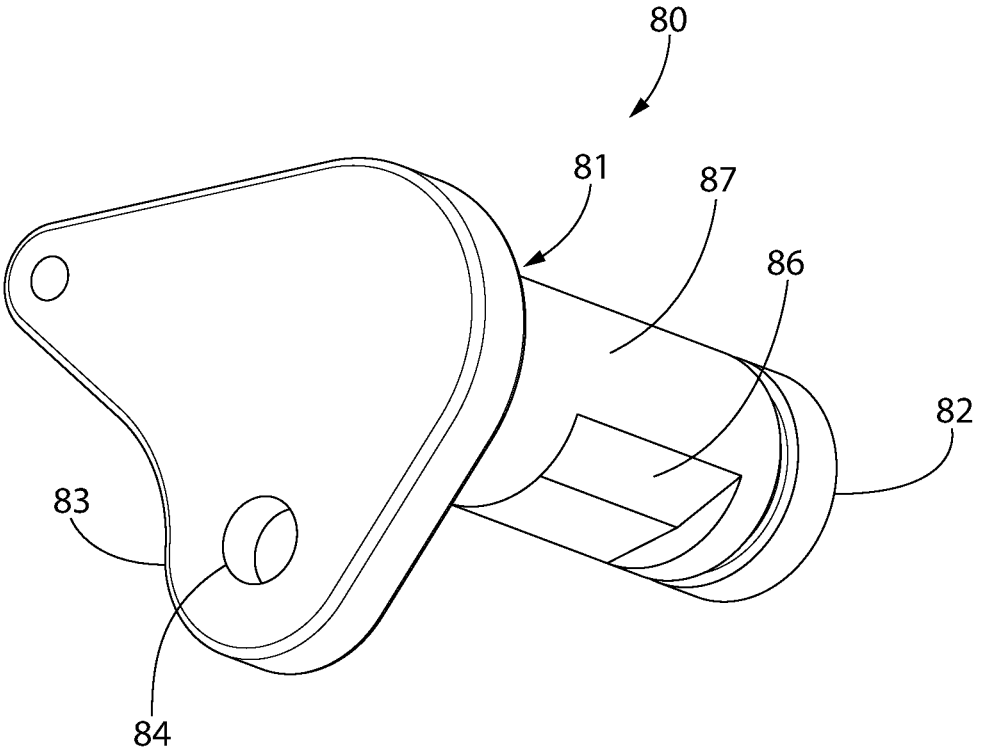
FIG. 22 is a left perspective view thereof.
Figure 23:
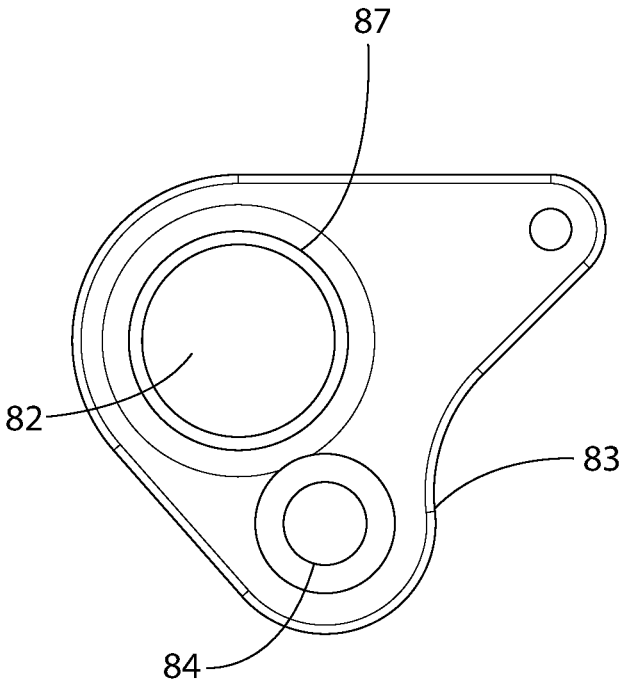
FIGS. 23 and 24 are right and left side views thereof.
Figure 24:
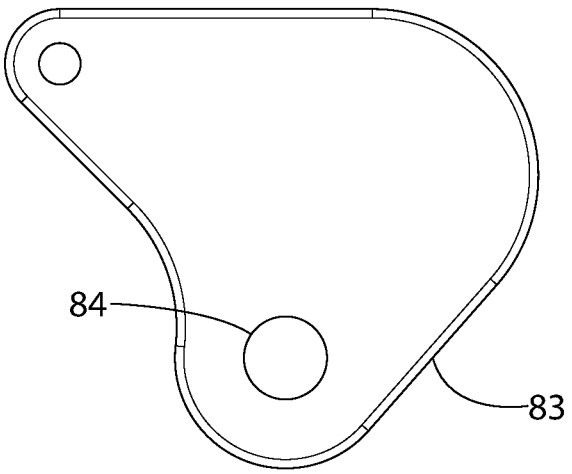
Figure 25:
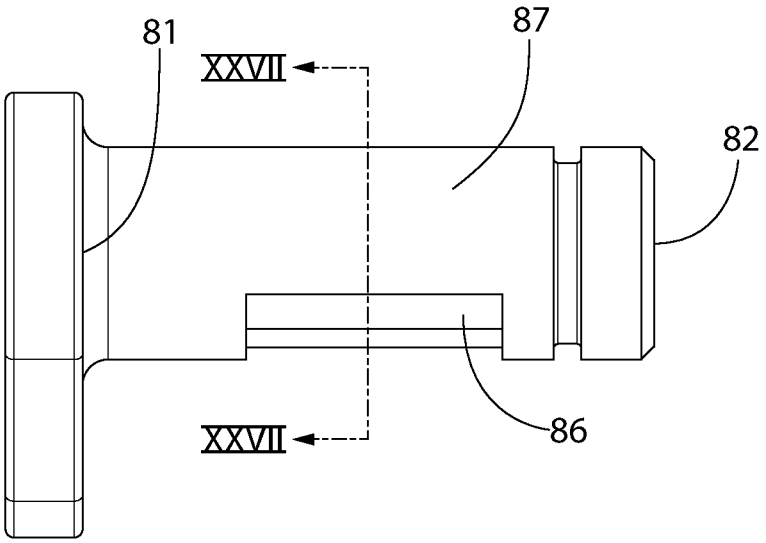
FIGS. 25 and 26 are rear and front views thereof.
Figure 26:
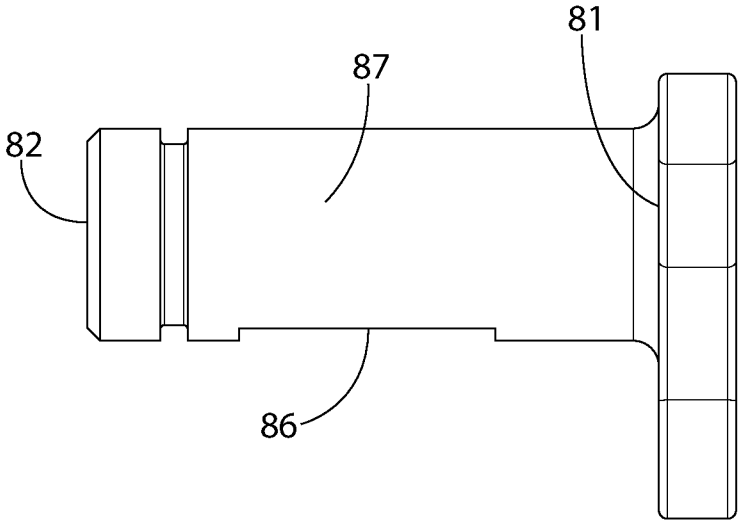
Figure 27:
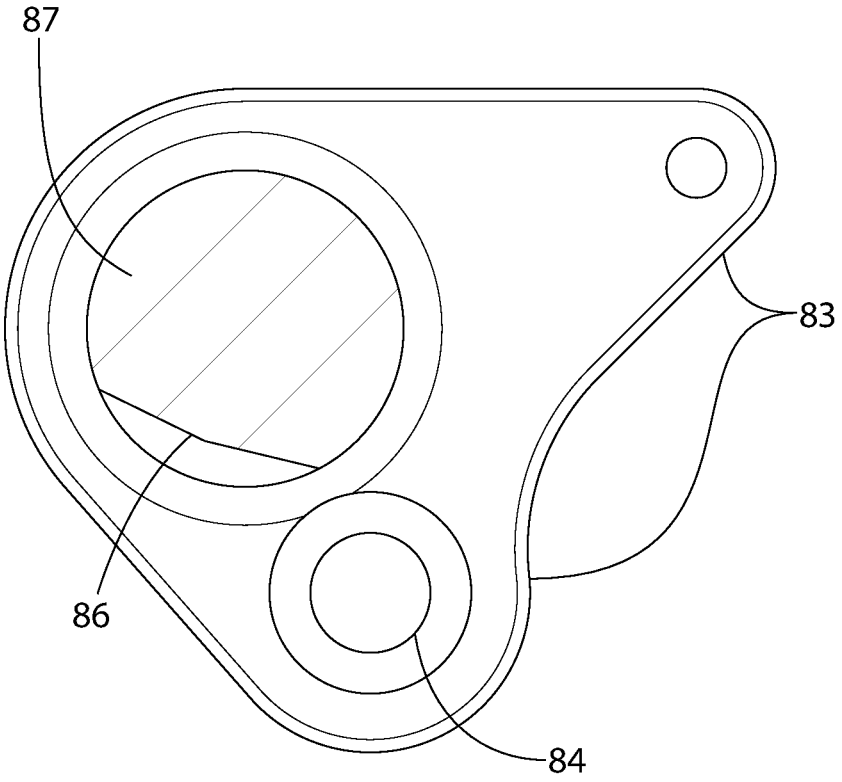
FIG. 27 is a transverse cross-sectional view thereof.
Figure 28:
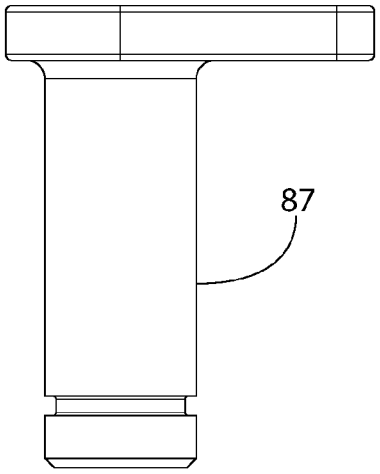
FIGS. 28 and 29 are top and bottom plan views thereof.
Figure 29:
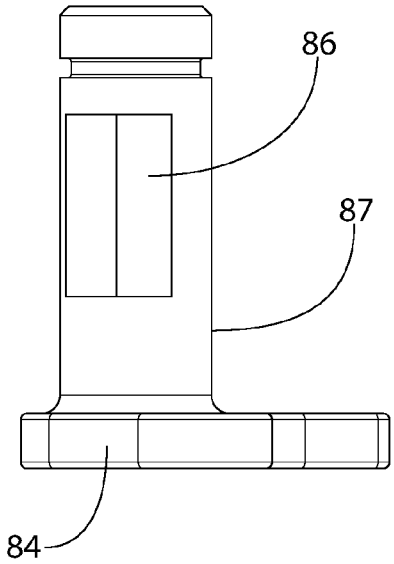

With reference now to FIGS. 12-20, the control shaft 71 of the safety selector 70 further comprises a flat surface 76 and a circumferentially adjoining arcuate surface 78 formed on either side of the flat in the reduced diameter central portion of the shaft. The flat surface 76 is rotatable in position with rotation of the safety selector control shaft 71 via the selector switch 74. In one embodiment, the portion of the control shaft 71 including the flat surface 76 may have a generally semi-circular shape in transverse cross section, as illustrated in FIG. 18. This shape lockingly mates with a complementary configured downwardly open vertical slot 111 formed in a rotary cam 110.

Referring to FIGS. 3 and 8-12, rotary cam 110 cooperates with the safety selector 70 and control rod 100 to impart rotational movement to the safety shaft 80 which is inaccessible to a user when the lower stock 60 is attached to the receiver 21. The rotary cam operates to convert rotary motion of the selector switch 74 and control shaft 71 coupled thereto into substantially linear axial motion of the control rod 100 which moves the safety shaft 80 between the blocking and unblocking positions by rotating the safety selector 70. Advantageously, this permits placement of the safety selector 70 rear of the trigger 28 on the left lateral side 68 of the lower stock for convenient use with pistol grip 27 formed on the lower stock.

Figure 8:
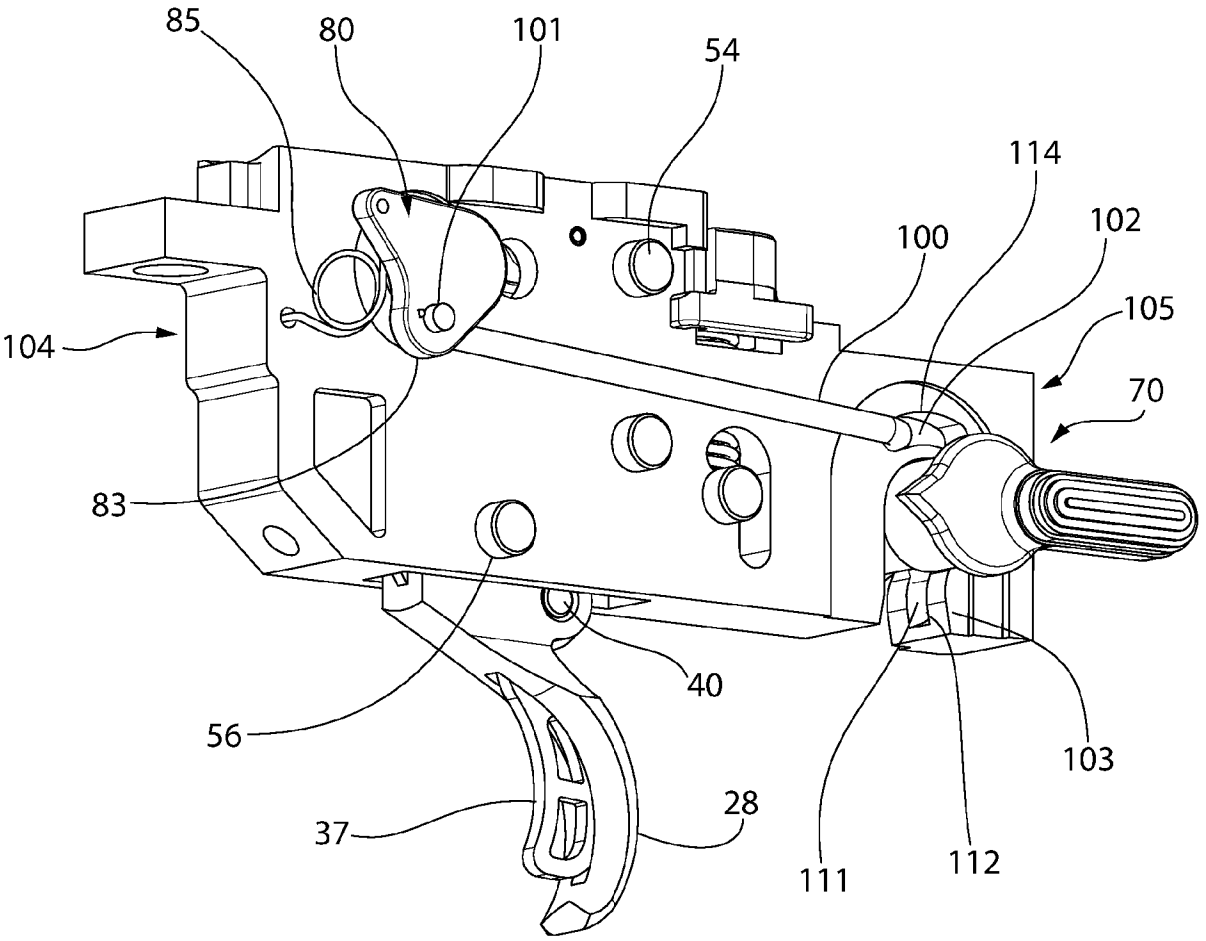
FIG. 8 is left perspective view of a removable trigger housing which houses the trigger actuated firing mechanism components.
Figure 10A:
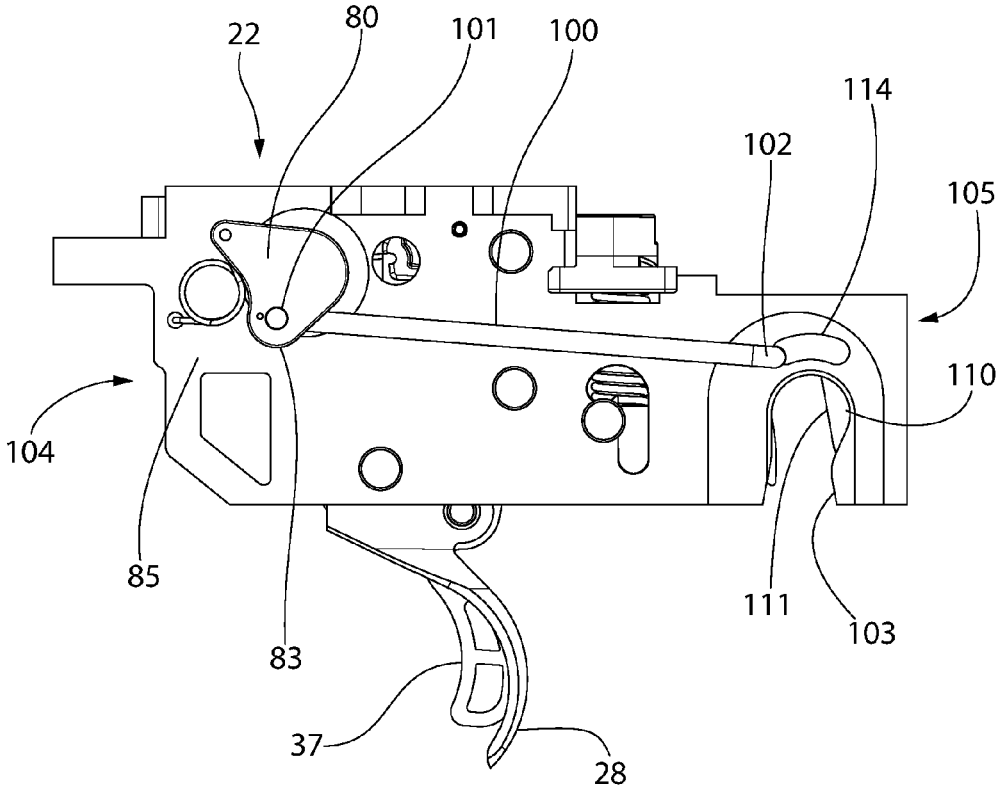
FIG. 10A is a left side view thereof associated with the safety selector in a "safe" firing mode position and the safety shaft engaging and preventing movement of the trigger to disable the firing mechanism.
Figure 10B:
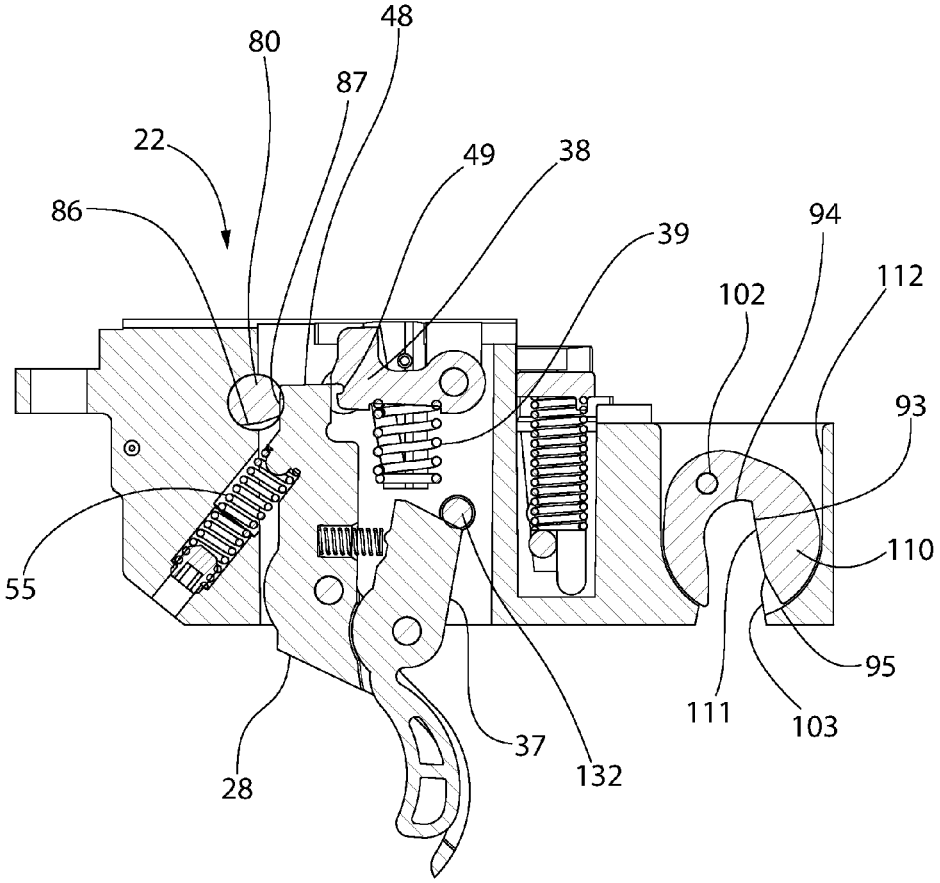
FIG. 10B is left side cross-sectional view thereof.
Figure 11A:
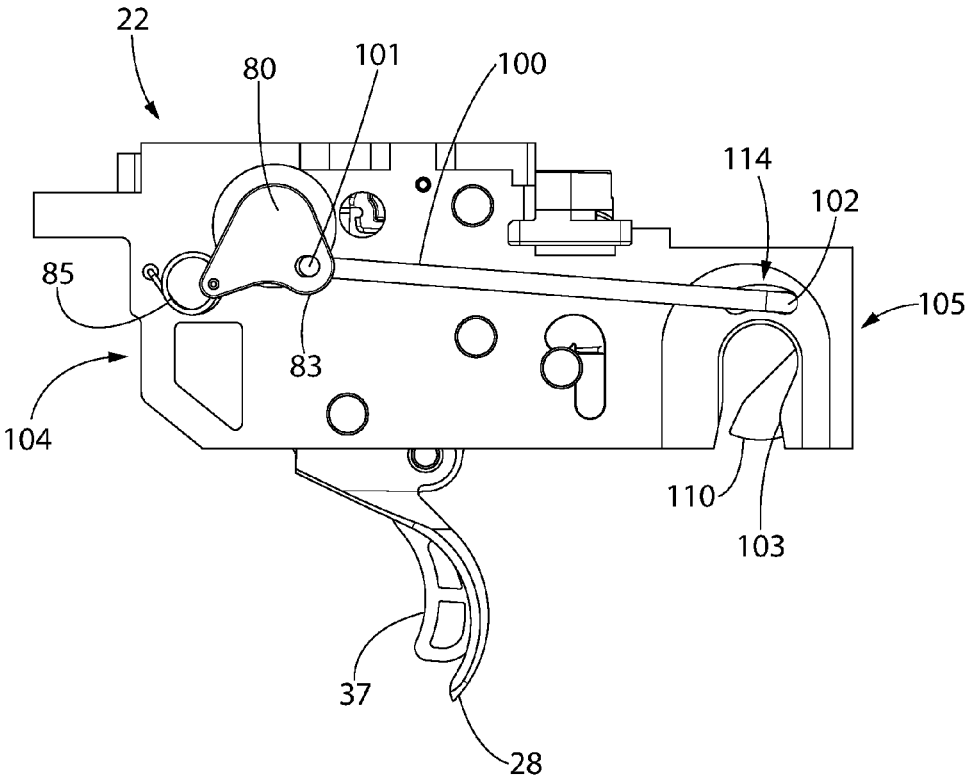
FIG. 11A is a left side view thereof associated with the safety selector in a "fire" firing mode position and the safety shaft disengaging and allowing movement of the trigger to enable the firing mechanism.
Figure 11B:
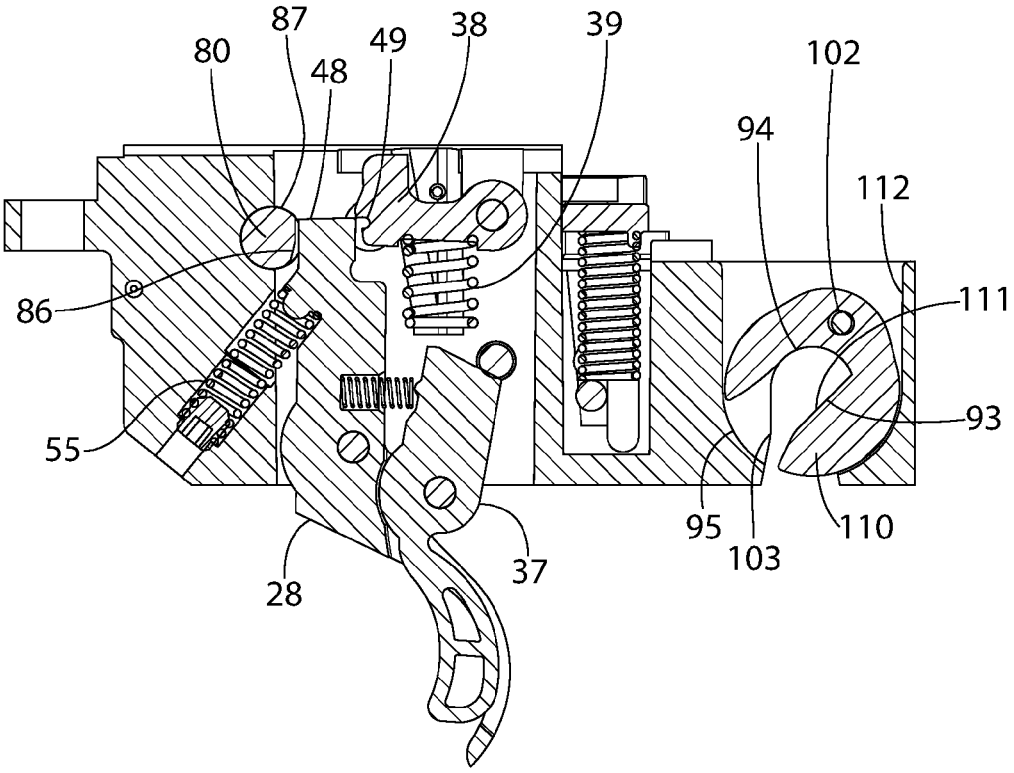
FIG. 11B is left side cross-sectional view thereof.

The rotary cam 110 is mounted in an upwardly open recess 112 formed near the rear end 105 of the trigger housing 22 (see, e.g. FIGS. 8, 10B, 11B). For point of reference, the safety shaft 80 is disposed near the front end 104 of the housing 22. Recess 112 has an axial width which is slightly but not overly larger than the diameter of the rotary cam body to allow the cam to be inserted downwards into the recess when the safety mechanism components are installed in the trigger housing 22. The recess 112 may have a U-shape in transverse cross section and circumscribes a downwardly open vertical slot 103 formed in the trigger housing 22. The slot 103 may extend transversely through both the right and left lateral sides 64, 65 of the housing. The lower portions of the recess 112 on each side of the slot 103 in trigger housing 22 are bounded by bottom arcuate walls 95 which complement and engage the circular shape of the body of the rotary cam 110 on each side of slot 111. The rotary cam 110 is seated and rotatable on the arcuate walls 95 when fully installed in the trigger housing. The lower end of the recess 112 is smaller than the diameter of the rotary cam 110 so that the cam cannot fall through the vertical slot 103 in the trigger housing 22.

Rotary cam 110 has a generally flat disk-like shape which is substantially but not perfectly circular in one embodiment as shown. In other embodiments, the shape may be perfectly circular. Rotary cam 110 has a downwardly open vertical slot 111 for upwardly receiving the safety selector control shaft 71 and an aperture 113 which receives a second hook-shaped curved end 102 of control rod 100 which is coupled thereto. Access through the trigger housing 22 for end 102 of the control rod to engage the aperture 113 of the rotary cam 110 may be provided through an arcuate slot 114 formed in the left lateral side 65 of the housing. The arcuate slot 114 is located to follow the arcuate path of the curved end 102 of the control rod 100 as the safety selector 70 is rotated.

The control shaft 71 of the safety selector 70 is removably received in both of the mating downwardly open slots 103, 111 disposed in the trigger housing 22 and the rotary cam 110, respectively. Slots 103 and 111 may have similar heights and axial widths which complement and are preferably slightly larger than the diameter of the safety selector control shaft 71 sufficient to allow both insertion and rotation of the shaft when positioned therein. Slot 111 of the rotary cam 110 has an open bottom end and a closed top end with a shape complementary to the shape semi-circular shape of the portion of the control shaft 71 containing the flat surface 76. Accordingly, the top end of slot 111 has a mating flat surface 93 and arcuate surface 94 (see, e.g. FIGS. 9, 10B, 11B). This provides a relatively tight interlocking fit and engagement between the control shaft 71 and rotary cam 110 such that rotating the shaft 71 concomitantly rotates the rotary cam.

The safety mechanism is operated in the following manner. Safety selector 70 is first assumed to be in the downward "fire" position shown in FIGS. 11A-C. The selector switch 74 is thus oriented obliquely to the longitudinal axis LA. In one embodiment, the selector switch 74 may be disposed at approximately 45 degrees to the longitudinal axis. The rotary cam 110 is oriented so that the lower rear quadrant obstructs the vertical slot 103 of the trigger housing 22. The rear curved end 102 of the control rod 100 is positioned at the rear of arcuate slot 114. The safety shaft 80 is in the unblocking position with the flat operating surface 86 of the positioned parallel to and facing the front surface 66 of the trigger 28. When the trigger is pulled, there is sufficient clearance between the safety selector 70 and front surface 66 of trigger 28 to allow the trigger sear catch protrusion 44 to move and release the sear 38 and firing pin 26 for discharging the firearm.

Figure 10C:
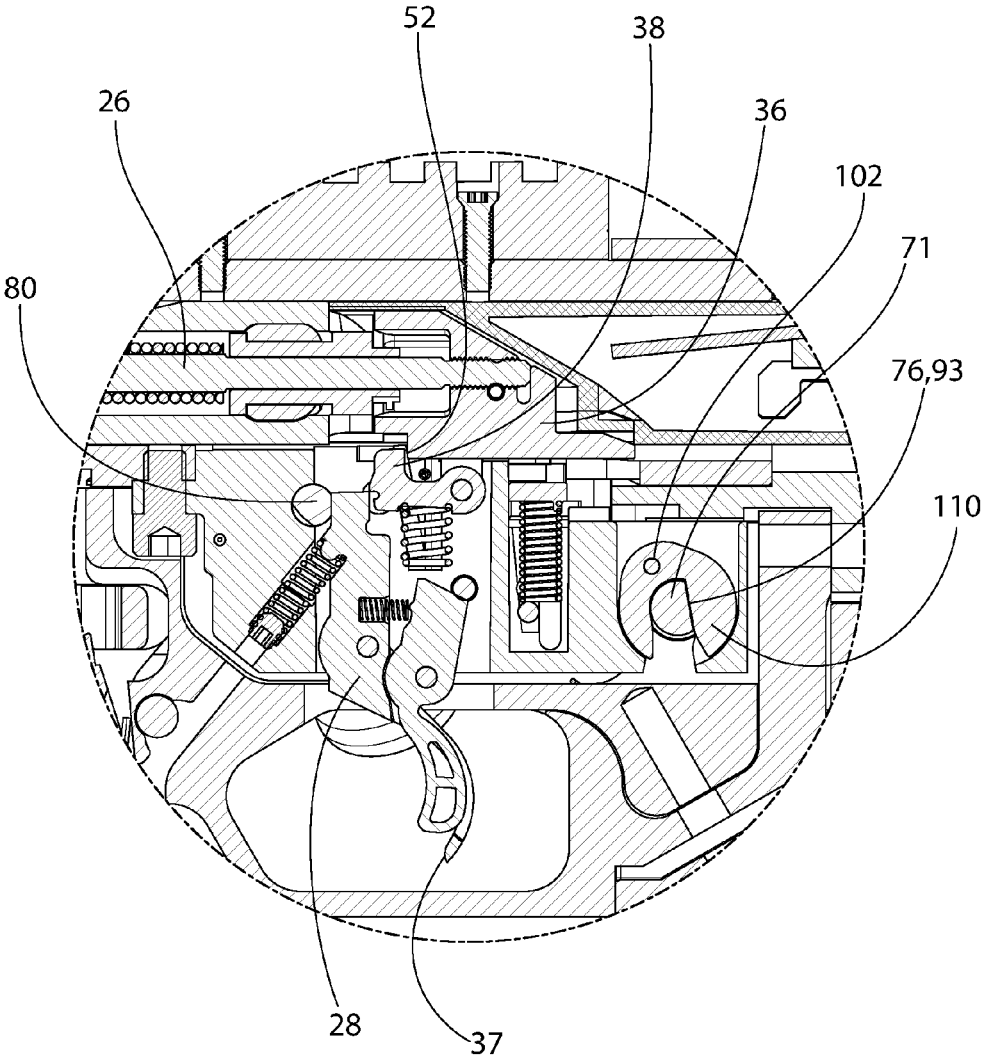
FIG. 10C is a left side cross-sectional view thereof showing portions of the receiver containing additional firing mechanism components which interact with the firing mechanism components of the trigger housing.

To activate the safety, the user moves and rotates the selector switch 74 upwards (counter-clockwise) to the horizontal "safe" position parallel to longitudinal axis LA as shown in FIGS. 10A-C. This concomitantly rotates the control shaft 71 of the safety selector 70 counter-clockwise. The rotary motion of the safety selector 70 moves or translates the control rod 100 axially forward. The curved end 102 of the control rod moves forward in turn to the front of the arcuate slot 114. The rotary cam 110 rotates counter-clockwise with the safety selector control shaft 71 such that the vertical slot 111 of the cam becomes vertically aligned with and approximately parallel to slot 103 of trigger housing 22. This would allow removal of the lower stock 60 from the receiver 21 if the firearm 20 were to be disassembled at this point, as already explained herein.

Figure 11C:
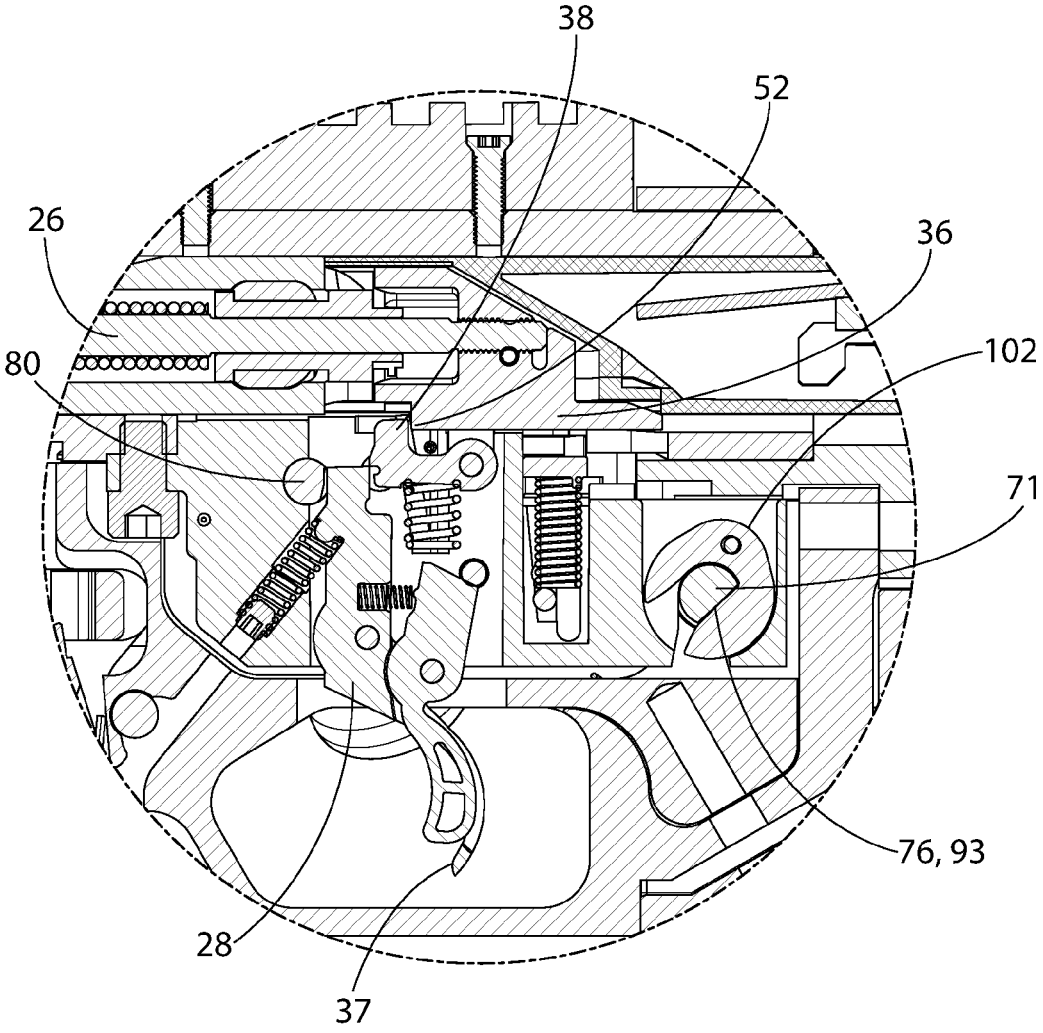
FIG. 11C is a left side cross-sectional view thereof showing portions of the receiver containing additional firing mechanism components which interact with the firing mechanism components of the trigger housing.

Counter-clockwise rotation of the safety selector 70 and accompanying forward movement of the control rod 100 in turn simultaneously rotates the safety shaft 80 clockwise (see again FIGS. 11A-C). The safety shaft 80 is now in the blocking position such that the flat operating surface 86 of the shaft has rotated forward and the arcuate blocking surface 78 has rotated rearward into engagement with the front surface 66 of the trigger 28. When a trigger pull is attempted, there no longer is sufficient clearance between the safety selector 70 and front surface 66 of trigger 28 to allow the sear catch protrusion 44 on the trigger to release the sear 38 and firing pin 26 for discharging the firearm. Instead, pivotal movement of the trigger is arrested, thereby disabling the firing mechanism.

The vertical slot 111 of the rotary cam 110 is rotatable in orientation with respect to the vertical slot 103 of the trigger housing 22 which remains stationary and fixed in position when mounted to the receiver 21. In another aspect of the invention, relative rotation between the rotary cam 110 and trigger housing 22 advantageously forms an interlock mechanism which prevents removal of the lower housing 60 from the receiver 21 when the safety selector 70 is in the "fire" position. The safety selector control shaft 71 is captured by the rotary cam 110 and the trigger housing 22, thereby preventing the lower assembly from being removed. While a firearm should always be unloaded before disassembly as dictated by responsible handling procedures, this mechanism is beneficial in that it ensures the safety of the firearm is engaged before the lower stock 60 can be removed and the trigger assembly is exposed. It also prevents the firearm from being re-assembled with the safety in the fire position.

Figure 4:
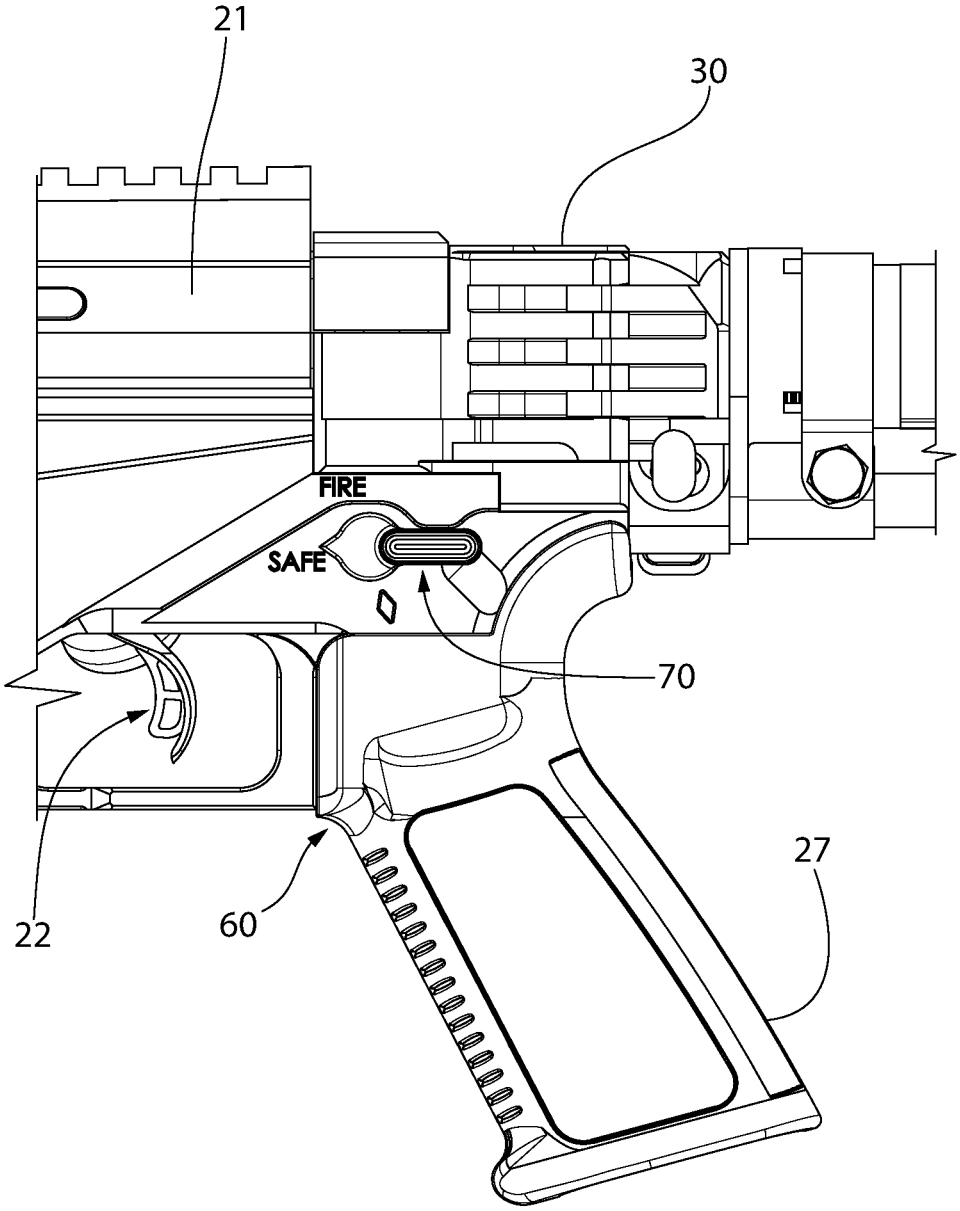
FIG. 4 is a partial left side view of the firearm showing the safety selector and pistol grip area of the firearm.

When the safety selector 70 is in the "safe" position shown in FIGS. 10A-C, the vertical slots 103, 111 of the trigger housing 22 and rotary cam 110 are vertically aligned and fully open to at least the full diameter of the control shaft 71 of the safety selector. This allows the control shaft and safety selector 70 to be withdrawn downwards and removed from the slots 103, 111 with the lower stock 60 (in which the safety selector is rotatably mounted as shown in FIG. 4) to exposed the trigger housing 22 and trigger mechanism. Conversely when the safety selector 70 is in the "fire" position shown in FIGS. 11-C, the vertical slots 103, 111 of the trigger housing 22 and rotary cam 110 are no longer vertically aligned and fully open to at least the full diameter of the control shaft 71 of the safety selector. The lower rear quadrant of the rotary cam now protrudes partially into and obstructs the slot 103 of the trigger housing 22 by a sufficient amount to prevent the control shaft 71 from passing downwards therethrough. Rotary cam slot 111 is no longer vertically aligned with but rather obliquely orientated to slot 103 of the trigger housing which traps the control shaft 71 of the safety selector 70 in the cam. This prevents the control shaft and safety selector 70 from being withdrawn downwards and removed from the slots 103, 111 when in the "fire" position so that the lower stock 60 cannot now be detached from the receiver 21, thereby forming an interlock mechanism.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A firearm with safety mechanism, the firearm comprising:

a receiver;

a barrel coupled to the receiver and defining a longitudinal axis;

a trigger housing detachably coupled to the receiver;

a trigger-actuated firing mechanism mounted in the trigger housing and operable to discharge the firearm via pulling a trigger;

a safety shaft extending transversely through the trigger housing and defining a first pivot axis, the safety shaft rotatable between a blocking position in which the safety shaft disables the firing mechanism and an unblocking position in which the shaft enables the firing mechanism to discharge the firearm;

a safety selector comprising a control shaft extending transversely through the trigger housing and defining a second pivot axis, the safety selector mechanically coupled to the safety shaft such that rotation of the safety selector rotates the safety shaft, the safety selector rotatable between a safe position and a fire position; and a selector switch disposed on a first end of the control shaft for rotating the safety selector;

wherein rotating the safety selector about the second pivot in a first direction from the safe position to the fire position rotates the safety shaft about the first pivot axis from the blocking position to the unblocking position; and wherein rotating the safety selector about the second pivot axis in a second direction from the fire position to the safe position rotates the safety shaft about the first pivot axis from the unblocking position to the blocking position.

2. The firearm according to claim 1, further comprising:

a rotary cam rotatably mounted in the trigger housing, the rotary cam lockingly engaged by the control shaft of the safety selector; and an axially elongated control rod coupling the safety selector to the safety shaft;

wherein the rotary cam converts rotary motion of the selector switch to linear motion of the control rod which moves the safety shaft between the blocking and unblocking positions by rotating the safety selector.

3. The firearm according to claim 2, wherein:

the control shaft of the safety selector is removably received in mating downwardly open slots disposed in the trigger housing and the rotary cam, wherein when the rotary cam is in a first rotational position, the slot in the rotary cam is in parallel alignment with the slot in the trigger housing to form a vertical withdrawal path which permits downward removal of the control shaft and safety selector from the trigger housing; and wherein when the rotary cam is in a second rotational position, the slot in the rotary cam is arranged obliquely to the slot in the trigger housing such that the rotary cam obstructs the vertical withdrawal path which prevents downward removal of the control shaft and safety selector from the trigger housing.

4. The firearm according to claim 3, wherein the control shaft of the safety selector comprises opposing abutment surfaces arranged to engage mating abutment surfaces formed on the trigger housing, the abutment surfaces on the safety selector and trigger housing acting in concert to prevent lateral removal of the safety selector from the trigger housing.

5. The firearm according to claim 2, wherein the safety shaft further comprises an oblong operating protrusion extending radially from a first end of the safety shaft, a first end of the control rod being coupled to the operating protrusion and a second end of the control rod being coupled to the rotary cam.

6. The firearm according to claim 5, wherein the safety shaft is positioned forward of the trigger and the safety selector is positioned rearward of the trigger.

7. The firearm according to claim 6, wherein:

the safety shaft comprises a substantially flat operating surface and a circumferentially adjoining arcuate blocking surface, the operating surface being arranged parallel to a front side of the trigger when the safety shaft is in the unblocking position to provide clearance which allows pivotable movement of the trigger for discharging the firearm; and the arcuate blocking surface engages the front side of the trigger when the safety shaft is in the blocking position to prevent pivotable movement of the trigger.

8. The firearm according to claim 1, wherein the safety shaft directly engages the trigger to prevent pivotable movement thereof when the safety shaft is in the blocking position.

9. The firearm according to claim 1, further comprising:

a lower stock detachably mounted to the receiver;

the safety selector mounted transversely in the lower stock and rotatably supported independently of the trigger housing such that removal of the lower stock removes the safety selector therewith.

10. The firearm according to claim 9 wherein the control shaft of the safety selector further extends transversely through the lower stock between opposing first and second lateral sides, the selector switch located on the exterior of the first lateral side of the lower stock for operational access.

11. The firearm according to claim 10, wherein a second end of the control shaft opposite the selector switch extends through the second lateral side and is exposed for viewing.

12. The firearm according to claim 11, wherein the second end includes indicia for verifying whether the safety selector is in the safe or fire position.

13. The firearm according to claim 9, wherein the lower stock includes a pistol grip.

14. The firearm according to claim 1, further comprising:

a manually operated bolt axially movable forward and rearward in the receiver, the bolt including a spring-biased firing pin and a cocking piece coupled to the firing pin;

a sear pivotably engaged between the trigger and cocking piece, the sear pivotable between a blocking position engaging the cocking piece to hold the firing pin in a rearward cocked position, and a non-blocking position in which the sear disengages and releases the firing pin via pivotable movement of the trigger to detonate a cartridge chambered in the barrel.

15. The firearm according to claim 14, wherein the safety shaft disables the firing mechanism by engaging the trigger to prevent pivotable movement thereof to release the sear when the safety shaft is in the blocking position.

16. The firearm according to claim 1, wherein the safety selector is mechanically coupled to the safety shaft by an axially elongated control rod.

17. The firearm according to claim 16, further comprising a diametrically enlarged operating protrusion extending radially from a first end of the safety shaft in a direction perpendicular to the safety shaft, a front end of the control rod coupled to the operating protrusion.

18. A trigger housing assembly attachable to a bolt-action firearm, the trigger housing comprising:

a body defining an interior space and longitudinal axis;

a firing mechanism disposed at least partially in the interior space, the firing mechanism operable to discharge the firearm via pulling a trigger movably mounted to the body;

a safety shaft extending transversely through the trigger housing and defining a first pivot axis, the safety shaft rotatable between a blocking position in which the safety shaft disables the firing mechanism and an unblocking position in which the shaft enables the firing mechanism to discharge the firearm;

a downwardly open vertical first slot formed in the body;

a rotary cam rotatably disposed in the body proximate to the first slot, the rotary cam comprising a second slot having an open end and a closed end;

the rotary cam rotatable between an aligned position in which the first and second slots are in vertical alignment and a misaligned position in which the second slot of the rotary cam is not in vertical alignment with the first slot of the body;

a control rod coupling the rotary cam to the safety shaft; and a safety selector comprising a control shaft defining a second pivot axis and elongated selector switch extending radially outward from a first end of the control shaft for operating the safety selector, the control shaft inserted transversely through the first and second slots of the body and rotary cam respectively, the control shaft forming a locking fit with the rotary cam such that rotating the safety selector concurrently rotates the rotary cam;

wherein rotating the safety selector about the second pivot in a first direction from the safe position to the fire position concurrently rotates the safety shaft about the first pivot axis from the blocking position to the unblocking position; and wherein rotating the safety selector about the second pivot axis in a second direction from the fire position to the safe position concurrently rotates the safety shaft about the first pivot axis from the unblocking position to the blocking position.

19. The trigger housing according to claim 18, wherein first and second pivot axes are parallel to each other and transversely oriented to the longitudinal axis.

20. The trigger housing according to claim 18, wherein a rear quadrant of rotary cam at least partially obscures the first slot of the body when the rotary cam is in the misaligned position.

21. The trigger housing according to claim 18, wherein the control shaft of the safety selector is vertically removable from the first and second slots when rotary cam is in the aligned position, and the lower quadrant prevents the control shaft of the safety selector from being vertically removable from the first and second slots when the rotary cam is in the misaligned position.

22. The trigger housing according to claim 21, wherein the safety selector is rotatably supported independently of the trigger housing in a lower stock detachably mounted to the receiver, the safety selector being removable with the lower stock by vertically removing the safety selector from the first and second slots.

23. The trigger housing according to claim 18, wherein the rotary cam has a circular shape and is rotatably disposed in a recess within the body which is bounded by bottom arcuate walls on each side of the first vertical slot.

24. A method for operating a safety mechanism of a firearm, the method comprising:

providing a firearm including a longitudinal axis, a receiver, a barrel supported by the receiver, and a trigger housing comprising (1) a trigger-actuated firing mechanism operable to discharge the firearm, (2) a rotary safety selector including a control shaft extending transversely through the trigger housing and a selector switch, (3) a rotary safety shaft extending transversely through the trigger housing and including a blocking surface and an operating surface, and (4) a control rod operably coupling the safety selector to the safety shaft;

rotating the safety selector in a first direction to a "safe" rotational position;

concurrently rotating the safety shaft in a second rotational direction via the control shaft by rotating the safety selector in the first direction;

engaging the blocking surface of the safety shaft with a trigger of the firing mechanism, wherein movement of the trigger is prevented to disable the firing mechanism;

rotating the safety selector opposite to the first rotational direction to a "fire" rotational position;

concurrently rotating the safety shaft opposite to the second rotational direction via the control shaft by rotating the safety selector opposite to the first rotational direction;

disengaging the blocking surface of the safety shaft from the trigger of the firing mechanism; and aligning the operating surface of the safety shaft to the trigger providing clearance such that movement of the trigger is not prevented to enable the firing mechanism.

25. The method according to claim 24, further comprising a rotary cam disposed in the trigger housing that operably couples the control rod to the safety selector, the rotary cam locking engaged with the control shaft of the safety selector such that the rotary cam is rotatable with rotation of the safety selector.

26. The method according to claim 24, wherein the firearm includes a pistol grip.

* * * * *